US007075859B2

(12) United States Patent
Miyahara et al.

(10) Patent No.: US 7,075,859 B2
(45) Date of Patent: Jul. 11, 2006

(54) RADIO-CONTROLLED TIMEPIECE AND CONTROL METHOD FOR THE SAME

(75) Inventors: Fumiaki Miyahara, Shiojiri (JP); Eisaku Shimizu, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 284 days.

(21) Appl. No.: 10/813,386

(22) Filed: Mar. 30, 2004

(65) Prior Publication Data

US 2004/0228219 A1 Nov. 18, 2004

(30) Foreign Application Priority Data

Mar. 31, 2003 (JP) ..... 2003-094457
Jan. 27, 2004 (JP) ..... 2004-018258

(51) Int. Cl.
*G04C 11/02* (2006.01)

(52) U.S. Cl. ..... 368/47

(58) Field of Classification Search ..... 368/46, 368/47, 52, 80, 185, 187
See application file for complete search history.

(56) References Cited

U.S. PATENT DOCUMENTS 3,732,685 A * 5/1973 Haydon ..... 368/60
3,748,846 A * 7/1973 Kikuchi ..... 368/47
4,358,836 A * 11/1982 Tohyama et al. ..... 368/47
4,392,217 A * 7/1983 Kumar et al. ..... 368/188
4,470,706 A * 9/1984 Nishimura et al. ..... 368/74
5,265,070 A 11/1993 Minowa
5,677,895 A * 10/1997 Mankovitz ..... 368/10

FOREIGN PATENT DOCUMENTS

| | | |
|---|---|---|
| EP | 0 657 793 A1 | 6/1995 |
| EP | 0 682 382 | 11/1995 |
| EP | 0 693 854 | 1/1996 |
| JP | 6-258461 | 9/1994 |

* cited by examiner

*Primary Examiner*—Vit W. Miska
(74) *Attorney, Agent, or Firm*—Rosalio Haro

(57) ABSTRACT

A watch has a crown for manual time adjustment, a receiver for receiving current time update signals by radio transmission, an internal counter for counting the passage of time according to an internal oscillator, and time display hands. The watch preferably does not have a means for determining the position of its time display hands and therefore relies on user intervention for roughly correlating its time display hands to its internal counter. Preferably, the user begins a manual time correction operation when the second hand is at a predetermined position between 0-60 seconds. When the crown is pushed in, the seconds count value of the internal counter is reset to the predetermined position, and the watch waits for reception of a current time radio signal. When a radio signal is successfully received, the received seconds value is compared to the seconds count in the internal counter. If the time difference is within +30 seconds, the internal time is deemed to be advanced by the difference, and if the time difference is within −30 seconds, the internal time is deemed to be delayed by the difference. The received time data is written into the internal counter, and the time display hands are moved according to the deemed time difference.

18 Claims, 15 Drawing Sheets

Hands manually adjusted to the current time

| | Internal counter | Hands | Received time data | Current time |
|---|---|---|---|---|
| Time changed with crown (crown pushed in) | 00 : 03 : 00 | 01 : 23 : 00 (hands manually adjusted) | ——— | 01 : 23 : 00 |
| Time signal received | 00 : 23 : 00 | 01 : 43 : 00 | 01 : 43 : 00 | 01 : 43 : 00 |
| Internal counter adjusted | 01 : 43 : 00 | 01 : 43 : 00 | 01 : 43 : 00 | 01 : 43 : 00 |
| Hands adjusted | 01 : 43 : 00 | 01 : 43 : 00 (hand adjustment unnecessary) | 01 : 43 : 00 | 01 : 43 : 00 |

FIG. 3

Manual adjustment of hands delayed 5 seconds to current time

| | Internal counter | Hands | Received time data | Current time |
|---|---|---|---|---|
| Time changed with crown (crown pushed in) | 00 : 03 : 00 | 01 : 23 : 00 (hands manually adjusted) | ——— | 01 : 23 : 05 |
| Time signal received | 00 : 22 : 55 | 01 : 42 : 55 | 01 : 43 : 00 | 01 : 43 : 00 |
| Internal counter adjusted | 01 : 43 : 00 | 01 : 42 : 55 | 01 : 43 : 00 | 01 : 43 : 00 |
| Hands adjusted | 01 : 43 : 00 | 01 : 43 : 00 (hands automatically adjusted) | 01 : 43 : 00 | 01 : 43 : 00 |

FIG. 4

Manual adjustment of hands advanced 15 seconds to current time

| | Internal counter | Hands | Received time data | Current time |
|---|---|---|---|---|
| Time changed with crown (crown pushed in) | 00 : 03 : 00 | 01 : 23 : 00 (hands manually adjusted) | ——— | 01 : 22 : 45 |
| Time signal received | 00 : 24 : 05 | 01 : 44 : 05 | 01 : 43 : 50 | 01 : 43 : 50 |
| Internal counter adjusted | 01 : 43 : 50 | 01 : 44 : 05 | 01 : 43 : 50 | 01 : 43 : 50 |
| Hands adjusted | 01 : 43 : 50 | 01 : 43 : 50 (hands automatically adjusted) | 01 : 43 : 50 | 01 : 43 : 50 |

FIG. 5

Manual adjustment of hands delayed 40 seconds to current time

| | Internal counter | Hands | Received time data | Current time |
|---|---|---|---|---|
| Time changed with crown (crown pushed in) | 00 : 03 : 00 | 01 : 23 : 00 (hands manually adjusted) | ——— | 01 : 23 : 40 |
| Time signal received | 00 : 21 : 20 | 01 : 41 : 20 | 01 : 42 : 00 | 01 : 42 : 00 |
| Internal counter adjusted | 01 : 42 : 00 | 01 : 41 : 20 | 01 : 42 : 00 | 01 : 42 : 00 |
| Hands adjusted | 01 : 42 : 00 | 01 : 41 : 00 (hands automatically adjusted) | 01 : 42 : 00 | 01 : 42 : 00 |

FIG. 6

Manual adjustment of hands advanced 40 seconds to current time

| | Internal counter | Hands | Time data | Current time |
|---|---|---|---|---|
| Time changed with crown (crown pushed in) | 00 : 03 : 00 | 01 : 23 : 00 (hands manually adjusted) | ——— | 01 : 22 : 20 |
| Time signal received | 00 : 24 : 30 | 01 : 44 : 30 | 01 : 43 : 50 | 01 : 43 : 50 |
| Internal counter adjusted | 01 : 43 : 50 | 01 : 44 : 30 | 01 : 43 : 50 | 01 : 43 : 50 |
| Hands adjusted | 01 : 43 : 50 | 01 : 44 : 50 (hands automatically adjusted) | 01 : 43 : 50 | 01 : 43 : 50 |

FIG. 7

Hands manually adjusted to the current time

| | Internal counter | Hands | Received time data | Current time |
|---|---|---|---|---|
| Time changed with crown (crown pushed in) | 2000/1/1 Sunday 00 : 03 : 20 : 00 | 2003/7/11 Friday 01 : 23: 30 (hands manually adjusted) | ——— | 2003/7/11 Friday 01 : 23: 30 : 00 |
| Time signal received | 2000/1/1 Sunday 00 : 22 : 50 : 00 | 2003/7/11 Friday 01 : 43 : 00 | 2003/7/11 Friday 01 : 43 : 00 : 00 | 2003/7/11 Friday 01 : 43 : 00 : 00 |
| Internal counter adjusted | 2003/7/11 Friday 01 : 43 : 00 : 00 | 2003/7/11 Friday 01 : 43 : 00 | 2003/7/11 Friday 01 : 43 : 00 : 00 | 2003/7/11 Friday 01 : 43 : 00 : 00 |
| Hands adjusted | 2003/7/11 Friday 01 : 43 : 00 : 00 | 2003/7/11 Friday 01 : 43 : 00 (hand adjustment unnecessary) | 2003/7/11 Friday 01 : 43 : 00 : 00 | 2003/7/11 Friday 01 : 43 : 00 : 00 |

FIG. 10

Manual adjustment of hands delayed 0.3 second to current time

| | Internal counter | Hands | Received time data | Current time |
|---|---|---|---|---|
| Time changed with crown (crown pushed in) | 2000/1/1 Sunday 00 : 03 : 00 : 00 | 2003/7/11 Friday 01 : 23: 00 (hands manually adjusted) | ——— | 2003/7/11 Friday 01 : 23: 00 : 30 |
| Time signal received | 2000/1/1 Sunday 00 : 22 : 59 : 70 | 2003/7/11 Friday 01 : 42 : 59 | 2003/7/11 Friday 01 : 43 : 00 : 00 | 2003/7/11 Friday 01 : 43 : 00 : 00 |
| Internal counter adjusted | 2003/7/11 Friday 01 : 43 : 00 : 00 | 2003/7/11 Friday 01 : 42 : 59 | 2003/7/11 Friday 01 : 43 : 00 : 00 | 2003/7/11 Friday 01 : 43 : 00 : 00 |
| Hands adjusted | 2003/7/11 Friday 01 : 43 : 00 : 00 | 2003/7/11 Friday 01 : 43 : 00 (hands adjusted automatically) | 2003/7/11 Friday 01 : 43 : 00 : 00 | 2003/7/11 Friday 01 : 43 : 00 : 00 |

FIG. 11

Manual adjustment of hands advanced 0.3 second to current time

| | Internal counter | Hands | Received time data | Current time |
|---|---|---|---|---|
| Time changed with crown (crown pushed in) | 2000/1/1 Sunday 00 : 03 : 00 : 00 | 2003/7/11 Friday 01 : 23: 00 (hands manually adjusted) | ——— | 2003/7/11 Friday 01 : 22: 59 : 70 |
| Time signal received | 2000/1/1 Sunday 00 : 23 : 00 : 30 | 2003/7/11 Friday 01 : 43 : 00 | 2003/7/11 Friday 01 : 43 : 00 : 00 | 2003/7/11 Friday 01 : 43 : 00 : 00 |
| Internal counter adjusted | 2003/7/11 Friday 01 : 43 : 00 : 00 | 2003/7/11 Friday 01 : 43 : 00 | 2003/7/11 Friday 01 : 43 : 00 : 00 | 2003/7/11 Friday 01 : 43 : 00 : 00 |
| Hands adjusted | 2003/7/11 Friday 01 : 43 : 00 : 00 | 2003/7/11 Friday 01 : 43 : 00 (hands not adjusted) | 2003/7/11 Friday 01 : 43 : 00 : 00 | 2003/7/11 Friday 01 : 43 : 00 : 00 |

FIG. 12

Internal counter delayed 4 seconds to current time

| | Internal counter | Hands | Current time |
|---|---|---|---|
| Error | 01 : 21 : 56 | 01 : 21 : 54 | 01 : 22 : 00 |
| Just before crown pushed in | 01 : 24 : 56 (immediately before reset) | 01 : 25 : 00 (adjust hands) | 01 : 25 : 00 |
| Just after crown pushed in | 01 : 25 : 00 (immediately after reset) Adjust internal counter | 01 : 25 : 00 | 01 : 25 : 00 |

FIG. 14

Internal counter delayed 40 seconds to current time

| | Internal counter | Hands | Current time |
|---|---|---|---|
| Error | 01 : 21 : 20 | 01 : 21 : 18 | 01 : 22 : 00 |
| Just before crown pushed in | 01 : 24 : 20 (immediately before reset) | 01 : 25 : 00 (adjust hands) | 01 : 25 : 00 |
| Just after crown pushed in | 01 : 24 : 00 (immediately after reset) (adjust internal counter) | 01 : 25 : 00 | 01 : 25 : 00 |

FIG. 15

RADIO-CONTROLLED TIMEPIECE AND CONTROL METHOD FOR THE SAME

BACKGROUND OF THE INVENTION

1. Field of the Invention

The present invention relates to a radio-controlled timepiece and to a control method for a radio-controlled timepiece.

2. Description of the Related Art

Radio-controlled timepieces that receive a radio signal (a longwave standard time signal) containing time data and automatically adjust and display the time based on this time data have become common in the last few years. Radio-controlled timepieces have conventionally been clocks such as mantle clocks and wall clocks, but have more recently also been rendered as wearable watches such as wristwatches.

Analog radio-controlled timepieces, however, are typically configured to detect the condition, or more specifically, the position, of the hands using a photodetector or electrical contacts, for example, and then to adjust the hands to match the received time data (see, for example, Japanese Unexamined Patent Appl. Pub. H08-179058), or are configured to adjust the hands to a predetermined time by operating the crown or push-buttons, and then to compare a count corresponding to that time with the received time data to adjust the time (see, for example, Japanese Unexamined Patent Appl. Pub. H06-258461).

The method for detecting the hand positions in Japanese Unexamined Patent Appl. Pub. H08-179058 is to render specific holes in specific gears of the movement, and detect the position of the hands by detecting the movement of these holes over the light path of a photodetector.

This configuration means that the light path of the photodetector is aligned through the thickness of the timepiece. In addition it being difficult to make the timepiece smaller with this configuration, it is also extremely difficult to render a hole in the small, precision gears that are used in a wristwatch, for example. Furthermore, the movement must be assembled so that the holes are aligned with the light path while the hands also point to a specified time. Improved manufacturability, improved productivity, and cost reductions can therefore not be achieved, and a smaller size cannot be achieved. Power is also consumed to drive the photodetector, and the usable operating time could be shortened as a result.

To achieve the time-setting operation described in Japanese Unexamined Patent Appl. Pub. H06-258461, the crown is turned to reset the hour hand, minute hand, and second hand to a predetermined time (such as 0:00:00). This resets the hour, minute, and second hand position counters to predetermined time counts corresponding to the predetermined time. At the same time, time data is input from a time data input circuit to the hour, minute, and second time counters for counting the time. The hand position counters are then incremented or decremented until the counts of the hand position counters match the counts of the time counters, and the hour hand, minute hand, and second hand are moved according to the increase or decrease in the counts to set the time.

With this method, however, the values of the hand position counters in the radio-controlled timepiece must be synchronized and initialized to the positions of the hour hand, minute hand, and second hand by resetting the hands to a predetermined time (such as 12:00). The operation for adjusting the time is therefore complicated, and the control process is also complicated due to the processing of the hour, minute, and second information.

It is therefore necessary with the conventional radio-controlled timepiece as described in Japanese Unexamined Patent Appl. Pub. H08-179058 above to render high precision holes in gears of the clock movement and to assemble the movement with high precision, thus preventing improvements in manufacturability and cost reductions, as well as preventing reductions in size due to limitations imposed by the construction. A further problem is that power consumption increases and a shortened usable time may be unavoidable.

Furthermore, with the conventional radio-controlled timepiece described in Japanese Unexamined Patent Appl. Pub. H06-258461, the values of the timekeeping counter inside the radio-controlled timepiece are synchronized to the positions of the hour, minute, and second hands to adjust the time by moving the hour hand, minute hand, and second hand to a predetermined time (such as 0:00:00) and initializing the hand position counter. As a result, all of the hands must be moved to the predetermined position. The problem is therefore that the time-adjusting operation is complicated and the control process is complex. More specifically, with most analog wristwatches the hour hand and minute hand are moved to adjust the hand positions by rotating the crown. Depending on the positions of the hands, the minute hand must therefore be turned multiple revolutions in order to move the hour hand to the predetermined position, and operation is difficult.

OBJECTS OF THE INVENTION

With consideration for the above problems, an object of the present invention is therefore to provide a radio-controlled timepiece and control method for the same whereby manufacturability and productivity can be improved, the cost can be reduced, and timepiece operation can be simplified.

It is a further object of the present invention to provide a radio-controlled timepiece that is easy to operate, affords improved manufacturability and productivity, and affords cost reduction.

SUMMARY OF THE INVENTION

A radio-controlled timepiece according to a first aspect of the present invention is a radio-controlled timepiece having a reception means for receiving a standard time signal containing time data, a timekeeping means for keeping time based on a reference signal from a reference signal source, a time display means having hands and indicating the time by means of the hands, a drive means for moving the hands according to the time, and an external operating member enabling changing the time display means by means of a specific input operation, and adjusting the time based on time data received by the reception means. Said radio-controlled timepiece is characterized by comprising an operation detection means for detecting a specific input operation of the external operating member; a controller for setting only the seconds value of the time kept by the timekeeping means to a specific value and starting timekeeping by the timekeeping means when the operation detection means detects the specific input operation; and a time-adjustment means for adjusting the time indicated by the time display means based on a time difference (time differential) between the seconds value of received time data and the seconds value of the timekeeping means when time data is first received after the specific input operation.

The invention thus comprised sets only the seconds value of the time kept by the timekeeping means to a predetermined value when the operation detection means detects a specific input operation of the external operating member. The time difference of this set value to the seconds value of the received time data is then detected, and the time displayed by the time display means is corrected based on this time difference. As a result, if, for example, the hour and minute values of the time indicated by the hands are manually changed using the external operating member to the time corresponding to the time data, even without also setting the hour and minute values of the kept time, the time indicated by the hands and the kept time can be synchronized, and the time can be easily adjusted using a simple configuration. That is, because the seconds value of the kept time is set to a predetermined value when a specific input operation of the external operating member is detected, the second hand and the seconds value of the kept time can be synchronized by setting the second hand to a position corresponding to the predetermined value when said input operation is performed. Therefore, even if the timing of the input operation of the external operating member is offset slightly from the current time (the actual time, such as Japan Standard Time in Japan), the second hand can be automatically set to the current time by adjusting the hands according to the time difference of the seconds value of the kept time to the seconds value of the received time data. It should be noted that if the hour hand and minute hand are set to the current time during the manual adjustment, there is very little chance of the hands shifting from the current time due to the timing of the input operation of the external operating member, and in practice the hour, minute, and second hands can be adjusted to the current time. It should be noted that adjusting the time indicated by the time display means can be done by the time-adjustment means controlling the drive means based on said time difference and moving the hands. Furthermore, until the specific input operation of the external operating member is detected after the time data is first received and the displayed time is adjusted, the received time data and the kept-time data are compared when time data is received, and the kept-time data and hands are adjusted based on the detected time difference. In other words, the time adjustment process of a typical radio-controlled timepiece is run.

Preferably, this radio-controlled timepiece also has a kept-time storage means for storing timekeeping data; and a current time storage means for storing time data received by the reception means and storing current time data updated from this time data by a reference signal from a reference signal source. In this case the controller sets only the seconds value of the time data stored by the kept-time storage means to a predetermined value when the operation detection means detects the specific input operation, and the time-adjustment means adjusts the time indicated by the time display means based on the time difference between the seconds value stored in the kept-time storage means when time data is first received after the specific input operation, and the seconds value of the received time data stored in the current time storage means.

The kept-time storage means and current time storage means in this configuration could be counters that are updated by an input reference signal.

Even if the timing of the input operation of the external operating member is offset slightly from the current time, the second hand can also be automatically set to the current time with this configuration by adjusting the hands according to the time difference of the seconds value of the kept time to the seconds value of the received time data.

Further preferably, the time-adjustment means adjusts the time data stored in the kept-time storage means to the received time data after obtaining the time difference when time data is first received after the specific input operation.

By correcting the time kept by the timekeeping means, that is, the time data stored in the kept-time storage means, to the received time data, if the hands are manually adjusted to the current time, the hands and the time data of the kept-time storage means can be synchronized when the standard time signal is received if even they are not synchronized when the hands are manually set to the current time. Therefore, because a hand position sensor such as conventionally required is not needed, and an operation for moving the hands to a predetermined position for synchronizing with the kept-time data can be eliminated, the parts count can be reduced when compared with a timepiece having a hand position sensor, manufacturability and productivity can be improved, cost can be reduced, and adjusting the hands of the timepiece is easier compared with a timepiece requiring synchronization of the hands.

Yet further preferably in this first aspect of the invention the controller determines that the seconds value set to a predetermined value and then counted is delayed relative to the seconds value of the received time data by the time difference therebetween if the time difference is within −30 seconds (less than 0 and greater than or equal to −30 seconds), and is advanced by the time difference if the time difference is within +30 seconds (greater than or equal to 0 and less than or equal to +30 seconds); and the time-adjustment means adjusts the indicated time based on this determination.

Thus comprised, if the time difference of the seconds value of the timekeeping means that is set to a predetermined value and updated by timekeeping to the seconds value of the received time data is within −30 seconds, the time is determined to be delayed by that time difference, and if the time difference is within +30 seconds, the time is determined to be advanced by that time difference, and the time is adjusted based on this determination. As a result, if a specific input operation is performed according to a time announcement and this operation is offset within +/−30 seconds of the time announcement, the offset can be automatically corrected. It is therefore not necessary to perform this input operation with precise timing, a radio-controlled timepiece that is easy for the user to operate can be provided, and the time can be easily adjusted by means of a simple process setting only the seconds value of the kept time to a predetermined value.

If the respective seconds values are compared based only on seconds values, the time difference can be acquired by determining if the difference between the seconds value of the timekeeping means and the seconds value of the received time data is less than or equal to 30 seconds. That is, if the seconds value of the timekeeping means relative to the seconds value of the received time data is in the range of less than or equal to +30 seconds, the time is determined to be advanced by that time difference, and if in the range of less than or equal to −30 seconds, the time is determined to be delayed by that time difference.

If the difference between the seconds value of the timekeeping means and the seconds value of the received time data is 30 seconds, the time could be determined to be advanced +30 seconds, or it could be determined to be delayed −3 seconds.

Which determination is used in this case can be either predefined, or determined with reference to the minute value of the time data. That is, if the minute value is also referenced when comparing the respective seconds values, it is possible to determine whether the set seconds value is less than or equal to −3 seconds or is less than or equal to +30 seconds of the received seconds value.

A specific method of determining the advance or delay is described next. That is, if the seconds value of the received time data is 0 seconds, and the seconds value of the timekeeping means is greater than or equal to 0 and less than 30 seconds, the time difference is known to be advanced less than or equal to +30 seconds, but if the seconds value is greater than or equal to 30 seconds and less than 60 seconds, the time difference is known to be delayed less than or equal to −3 seconds. Furthermore, if the seconds value of the received time data is 0, the time difference is known to be advanced less than or equal to +30 seconds if the seconds value of the timekeeping means is greater than or equal to 0 and less than or equal to 30 seconds, and if greater than 30 seconds and less than 60 seconds, is known to be delayed less than or equal to −3 seconds.

Further preferably, the controller sets the seconds value of the kept time to 0 seconds as the specific predetermined value. More specifically, the predetermined value of the seconds value set by the controller is preferably 0 seconds.

As a result, when the time is manually changed, the time can be set with the second hand pointing to 0:00 (12:00), the time can therefore be set using the same time-setting operation as a common watch, operation is simple, and determining whether the time is advanced or delayed is easy.

Further preferably, the controller sets the seconds value of the kept time to 0 seconds as the predetermined value, determines that the seconds value set to 0 and kept by the timekeeping means is advanced relative to the seconds value of the received time data by the time difference therebetween if said time difference is greater than or equal to 0 seconds and less than 30 seconds, and is delayed by the time difference if said time difference is greater than or equal to 30 seconds and less than 60 seconds; and the time-adjustment means adjusts the indicated time based on this determination.

With this configuration, if the time difference between the seconds value set to 0 in the time of the timekeeping means and the seconds value of the received time data is greater than or equal to 0 seconds and less than 30 seconds, the time is known to be advanced by that time difference, and the time difference is known to be delayed by the time difference if the difference is greater than or equal to 30 seconds and less than 60 seconds. The time can then be adjusted based on this determination. As a result, the time can be easily and accurately adjusted by the simple process of setting only the seconds value of the kept time to 0 seconds.

A radio-controlled timepiece according to a second aspect of the invention is a radio-controlled timepiece having a reception means for receiving a standard time signal containing time data, a timekeeping means for keeping time based on a reference signal from a reference signal source, an analog time display means having hands for indicating the time, a drive means for driving the analog time display means according to the time, an external operating member enabling changing the time display means by means of a specific input operation, an operation detection means for detecting a specific input operation of the external operating member, a time-adjustment means for adjusting the time based on time data received by the reception means; and is characterized by the time-adjustment means, when time data is first received after the operation detection means detects the specific input operation of the external operating member, setting corresponding time data in the time data kept by the timekeeping means (the kept-time data) using at least part of received information in the received time data, and until a specific input operation of the external operating member is subsequently detected, comparing received time data and the kept-time data when time data is thereafter received, and based on a time difference therebetween adjusting the kept-time data and the hands.

When the timekeeping means is initialized because the battery is replaced, for example, and the kept-time and time indicated by hands or other analog time display means therefore go out of synchronization, the user then sets the hands to the current time using the external operating member and executes the specific input operation of the crown or external operating member, the movement starts without the timekeeping data and the hands being synchronized. When time data is then received for the first time, at least part of the received information in the received time data is written to the timekeeping data. This at least part of the received information could be, for example, only the hour, minute, and second time data from the received time data, or only the date, day, or other calendar information, or both the time data and calendar information.

Thus, by synchronizing the current time denoting the time data and the time indicated by the hands (time data and calendar information) when the hands are first set, and then setting part of the time data in the timekeeping data, the timekeeping data and hands are also synchronized. Therefore, because the timekeeping data and hands are now synchronized, the time can be correctly calibrated using the received time data.

It is therefore not necessary in the present invention to provide a hand position sensor as is required in the cited reference to Japanese Unexamined Patent Appl. Pub. H08-179058, it is also not necessary to synchronize the internal counter and hands as is described in Japanese Unexamined Patent Appl. Pub. H06-258461. In the present invention, the kept-time and hand positions can be synchronized by simply performing the typical operation of setting the hands to the current time by manipulating a crown, as is done in a conventional analog watch Therefore, in this radio-controlled timepiece, the configuration of the timepiece can be simplified, cost can be reduced, and operability can be improved.

More specifically, if time data is first received after the operation detection means detects a specific input operation of the external operating member, which can change the time indicated by the time display means, the present invention can set at least part of the received information in the timekeeping data. Therefore, values of the timekeeping data can be correctly adjusted to the received time, that is, the current time, regardless of initialization when the specific input operation is executed. As a result, when the information of the analog time display means set by the external operating member to the timekeeping data using the received information, such as the calendar information when only the date or day of the calendar information is set to the received information, is manually changed to the current time by the external operating member, the value of the timekeeping data and the value indicated by the analog time display means will match and be synchronized when the timekeeping data is overwritten by the received data without initializing the timekeeping data and the analog time display means, and without providing a sensor for detecting the hand positions of the analog time display means, and easy time calibration is possible with a simple construction.

Preferably, this second aspect of the invention further comprises a kept-time storage means for storing kept-time data; and a current time storage means for storing time data received by the reception means and storing current time data updated from this time data by a reference signal from a reference signal source. When time data is first received after the operation detection means detects a specific input operation of the external operating member, the time-adjustment means sets at least part of the received information in the received time data to the kept-time storage means, and until a specific input operation of the external operating member is detected, compares received time data and time data in the kept-time storage means when time data is thereafter received, and based on a time difference therebetween adjusts the kept-time storage means and the hands.

The kept-time storage means and current time storage means in this configuration could be counters that are updated by an input reference signal.

It is therefore not necessary to provide a hand position sensor, it is also not necessary to synchronize the kept-time data and hands, and by simply performing the same operation of setting the hands to the current time and pushing in the timepiece's crown, which is used to set the time in a conventional analog timepiece, the kept-time and hand positions can be synchronized in this radio-controlled timepiece, the configuration of the timepiece can be simplified, cost reduced, and operability improved.

Further preferably in this second aspect of the invention the analog time display means comprises hands (analog time display means) for indicating time data composed of hours, minutes, and seconds, and an analog calendar display means for indicating calendar data including a date. The timekeeping means is configured for keeping time information including said time data and calendar data; and the time-adjustment means, when time information is first received after the operation detection means detects a specific input operation of the external operating member, stores at least the calendar data from the received time information in the kept-time storage means.

This configuration has an analog time display means, typically an hour hand, minute hand, and second hand, for indicating time data composed of hours, minutes, and seconds, and an analog calendar display means, typically a date ring or day ring, for indicating calendar information including the date. When the time data is received for the first time after the specific input operation of the external operating member is detected, only the calendar data of the received time information could be set in the kept-time storage means, or both the calendar data and time data could be set in the kept-time storage means, but setting only the calendar data of the received time data in the kept-time storage means is preferable.

This second aspect of the invention could also comprise a hand position detection means for detecting the positions of the hands indicating the time composed of hour, minute, and second values, and the time-adjustment means could set only the calendar information of the received time data to the kept-time storage means when the time data is first received after the operation detection means detects the specific input operation of the external operating member.

When of the received time data only the calendar data is set to the kept-time storage means, the hour-minute-second time data can be processed as in a conventional radio-controlled timepiece by initializing the kept-time storage means and hands, or by using a hand position detection means (hand position sensor) for sensing the positions of the hands.

Because it is not necessary to provide a sensor for detecting the position of the date ring or other analog calendar display means, or initialize, the time can be easily adjusted and the timepiece made smaller. A date ring must move from 1 to 31 days, and moving the date ring becomes complicated when initialization is required. Providing a sensor therefore requires commensurate space inside the timepiece, making it difficult to make the timepiece small and thin. The present invention, however, makes it simple to adjust the time, and enables making the timepiece small and thin.

It should be noted that providing a hand position detection means also has the advantage of improving usability as a radio-controlled timepiece because the hands can be automatically adjusted to the current time when the standard time signal is received.

Furthermore, because the hand position detection means can also be rendered unnecessary and initialization can be rendered unnecessary when, in addition to the analog calendar display means, the analog time display means can be manually adjusted to the time data of the current time and the time data part of the kept-time storage means can be set using the received information, the timepiece can be made small and thin, and the time can be easily adjusted using the same operation used with a conventional quartz watch.

This second aspect of a radio-controlled timepiece according to the present invention preferably also comprises a controller, and is characterized by the time data of the standard time signal being transmitted as signals at one-second intervals; the controller comparing timing of a change in each signal in the received time data and timing of a change in a reference signal of the timekeeping means, and if the timing of the change in the timekeeping means relative to the timing of the change in the received information is within +0.5 second (greater than or equal to 0 and less than or equal to +0.5 second), determining that the time is advanced by the time difference, and determining that the time is delayed by the time difference if said time difference is within −0.5 second (less than 0 and greater than or equal to −0.5 second; and the time-adjustment means adjusting the kept time based on this determination.

If the user moves the hands to the current time and the timing of the input operation of the external operating member deviates somewhat from the time announcement, for example, this configuration of the invention can automatically correct the deviation, and the indicated time can therefore be set precisely to the current time. It should be noted that if this deviation is greater than +/−0.5 second, such as 1 second, the deviation cannot be corrected. However, because when the user sets the time based on a time announcement this deviation is usually within +/−0.5 second, correction to the correct time is usually possible.

A control method for a radio-controlled timepiece according to a third aspect of the invention is a control method for a radio-controlled timepiece that adjusts a kept time indicated by hands based on a received standard time signal containing time data, and is characterized by setting only the seconds value of the kept time to a predetermined value and starting timekeeping when a specific input operation by an external operating member that can change the displayed time is recognized, and adjusting the displayed time based on a time difference between the seconds value of the kept time when the time data is first received after this predetermined value is set, and the seconds value of the received time data.

The same practical benefits achieved by the first aspect of the invention as described above are achieved by the radio-controlled timepiece control method of this third aspect of the invention.

This third aspect of the invention preferably recognizes the time difference of the seconds value set to a predetermined value in the kept time to the seconds value of the received time data, determines the time to be delayed by the time difference if this detected time difference is within −3 seconds, and advanced by the time difference if the time difference is within +30 seconds, and adjusts the kept time based on the result of this determination.

Further preferably, this predetermined value is 0 seconds.

Further preferably, this predetermined value is 0 seconds, the time difference of the seconds value set to 0 seconds in the kept time to the seconds value of the received time data is recognized, the time is determined to be advanced by the time difference if the detected time difference is greater than or equal to 0 second and less than or equal to 29 seconds, the time is determined to be delayed by the time difference if the difference is greater than or equal to 30 seconds and less than or equal to 59 seconds, and the time is adjusted based on the result of this determination.

Yet further preferably, the kept time is preferably corrected based on the detected time difference.

Thus comprised, this aspect of the invention achieves the same practical benefits as the other variations of the first aspect of the invention.

A control method for a radio-controlled timepiece according to a fourth aspect of the invention is a control method for a radio-controlled timepiece that adjusts a kept time indicated by an analog time display means having hands based on a received standard time signal containing time data, and is characterized by, when time data is first received after a specific input operation of an external operating member that can change the displayed time is recognized, setting corresponding kept-time data in time data kept by a time-keeping means using at least part of received information in the received time data, and until a specific input operation of the external operating member is detected, comparing received time data and the kept-time data when time data is thereafter received, and based on a time difference therebetween adjusting the kept-time data and the hands.

A radio-controlled timepiece control method according to this fourth aspect of the invention affords the same practical benefits as the second aspect of the invention described above.

Effect of the Invention

As described above, by manually changing by means of an external operating member, for example, the hour and minute values of the time indicated by hands to the time corresponding to time data, the radio-controlled timepiece and control method therefor according to the present invention can synchronize the kept time and the time indicated by the hands without also setting the hour and minute values of the kept time, and the time can be easily adjusted by means of a simple construction.

Furthermore, by changing by means of an external operating member, for example, the hour, minute, and seconds values of the time indicated by hands manually to the time corresponding to time data, the radio-controlled timepiece and control method therefore according to the second and fourth inventions can synchronize the time indicated by the hands and the kept time without also setting the hour, minute, and seconds values of the kept time, and the time can be easily adjusted by means of a simple construction.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

FIG. 3 describes time adjustment when the time is set to the current time.

FIG. 4 describes time adjustment when the time is set delayed 5 seconds.

FIG. 5 describes time adjustment when the time is set advanced 15 seconds.

FIG. 6 describes time adjustment when the time is set delayed 40 seconds in order to describe the operation of this embodiment.

FIG. 7 describes time adjustment when the time is set advanced 40 seconds in order to describe the operation of this embodiment.

FIG. 10 describes time adjustment when the time is set to the current time in the second embodiment.

FIG. 11 describes time adjustment when the time is set delayed 0.3 second.

FIG. 12 describes time adjustment when the time is set advanced 0.3 second.

FIG. 14 describes time adjustment when the time is set delayed 4 seconds in the alternative embodiment.

FIG. 15 describes time adjustment when the time is set delayed 40 seconds in the alternative embodiment.

DESCRIPTION OF THE PREFERRED EMBODIMENTS

Best Mode for Achieving the Invention

First Embodiment

A first embodiment of the present invention is described below with reference to the accompanying figures.

This embodiment of the invention is described in reference to a timepiece having time-indicating hands, that is, in reference to an analog timepiece having an hour hand, a minute hand, and a second hand and indicating the time by means of these hands, but the invention can also be applied to timepieces that do not have a second hand, as well as to timepieces that have a calendar function. The timepiece could also be either a clock or a watch.

Configuration of a Radio-controlled Timepiece

Figure 1:
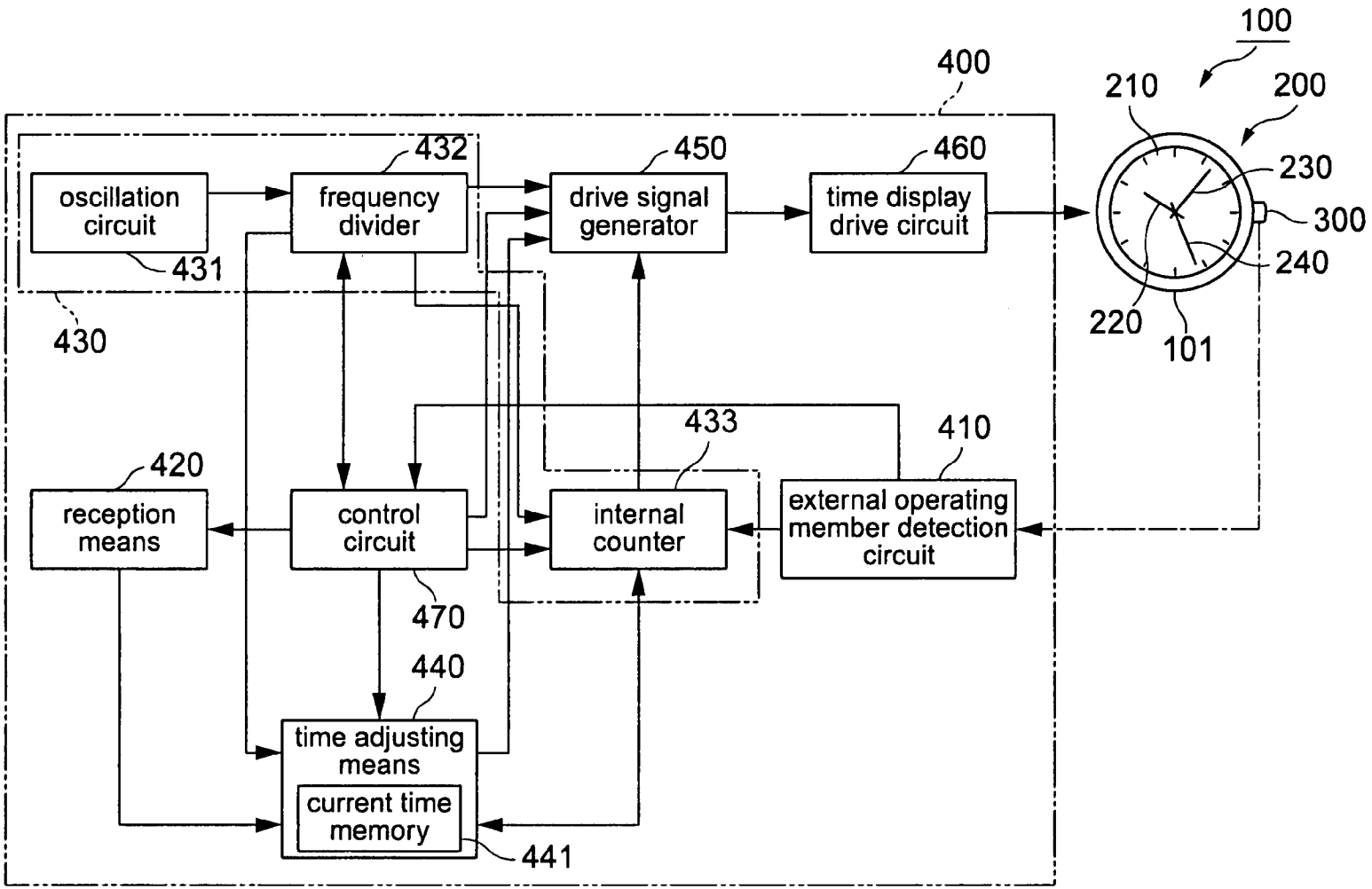
FIG. 1 is a block diagram showing the internal configuration of a radio-controlled timepiece according to a first embodiment of the present invention.

FIG. 1 is a block diagram showing the internal configuration of a radio-controlled timepiece 100 according to this first embodiment of the invention.

The radio-controlled timepiece 100 shown in FIG. 1 has a case 101.

Inside the case 101 are a time display means 200 for indicating the time, a drive means for driving the time display means to show the time, a crown 300 as an external operating member for externally operating the timepiece, and a control means 400 for controlling the overall operation of the timepiece.

The time display means 200 is an analog movement having a dial 210 composed of case with a scale, and an hour hand 220, minute hand 230, and second hand 240. It should be noted that the dial 210 shall not be limited to one having a scale, and could have numbers for indicating the time, or it could be blank with no numbers, or it could be printed with images. The timepiece could also be configured without a dial.

The hour hand 220, minute hand 230, and second hand 240 are advanced appropriately by the drive means. The hour hand 220, minute hand 230, and second hand 240 also indicate the time by pointing to specific positions on the dial 210. If the timepiece does not have a dial 210, the user can still know the time from the relative rotary positions of the hour hand 220, minute hand 230, and second hand 240.

The drive means could be a stepping motor, for example. The drive means is driven by a specific signal from the control means 400 to move the hands. The drive means shall also not be limited to a stepping motor, and could be a piezoelectric actuator or other device capable of moving the hands.

The crown 300 is disposed so that it can be pushed into and pulled out from the case 101. When the user manually pulls the crown 300 out to the time-setting position, the displayed time can be changed by means of the user rotating the crown 300, thereby turning the hands and changing the displayed time. When the crown 300 is pushed in, the time cannot be changed manually and the hands are advanced normally by the movement driven by the drive means.

The control means 400 is an electronic circuit configuration incorporating an IC (Integrated Circuit) or other electronic components, and keeps the time and adjusts the time of the radio-controlled timepiece 100.

The control means 400 is composed of an external operating member detection circuit 410 as a means for detecting operation of the crown 300, a reception means 420 for receiving a standard RF signal that is a radio signal containing time data denoting the current time (the actual current time, which in Japan is Japan Standard Time, JST), a timekeeping means 430 for keeping the time indicated by the hands using an oscillation circuit 431 inside the radio-controlled timepiece 100, a time adjusting means (clock time adjusting means) 440, drive signal generator 450, time display drive circuit 460, and control circuit 470 (control unit).

The external operating member detection circuit 410 has an on/off switch, for example, that turns on and off in conjunction with operation of the crown 300. The external operating member detection circuit 410 detects specific input operations when the crown 300 is pulled out to the time-setting position for changing the displayed time, and the crown 300 is then pushed in from this time-setting position to the idle position at which the displayed time cannot be changed by the crown 300. When the external operating member detection circuit 410 detects specific input operations, it sends a specific operation detection signal to the control circuit 470.

The reception means 420 has a tuning circuit not shown composed of a tuning capacitor, for example. The reception means 420 is controlled by the control circuit 470, and is configured to receive a longwave standard time signal at a frequency set by the tuning circuit via an antenna that is not shown in the figure. In Japan, for example, the signal received as this longwave standard time signal is broadcast at two different frequencies, that is, at 40 kHz by the transmitting station on Mt. Otakadoya for eastern Japan, and at 60 kHz by the transmitting station on Mt. Hagane for western Japan.

The reception means 420 also has an amplifier circuit, bandpass filter, demodulation circuit, and decoding circuit not shown in the figure, and extracts digital time data, that is, a digital time code, from the received longwave standard time signal. The extracted time code is then output to the time adjusting means 440.

The timekeeping means 430 is composed of an oscillation circuit 431, frequency divider 432, and internal counter 433.

The oscillation circuit 431 is connected to a reference signal source not shown such as a quartz oscillator.

The oscillation circuit 431 causes the reference signal source to oscillate at a predetermined high frequency, and outputs the oscillation signal generated by this high frequency oscillation to the frequency divider 432.

The frequency divider 432 is controlled by the control circuit 470, and receives and frequency divides the oscillation signal output from the oscillation circuit 431. When the control circuit 470 recognizes a specific input operation of the crown 300 (that is, when the crown 300 is pushed in), the control circuit 470 applies a specific signal to the frequency divider 432, which then resets the frequency dividing process. The frequency dividing process is reset to synchronize the timing of the crown 300 being pushed in to the output timing of the reference signal output from the frequency divider 432. The frequency divider 432 then outputs a predetermined reference signal such as a 1-Hz pulse signal to the internal counter 433, time adjusting means 440, drive signal generator 450, and control circuit 470.

The internal counter 433 is composed of an hour counter, minute counter, and second counter, for example, each of which is an up-counter. The internal counter 433 stores the kept time by, for example, storing counts denoting hour, minute, and seconds values for the time hh:mm:ss. The time is kept by acquiring a pulse signal from the frequency divider 432 and incrementing the value of the seconds count as each second passes. The internal counter 433 can therefore be said to be composed of an hour counter, minute counter, and seconds counter. As a result, a kept-time storage means that stores the kept-time data is thus rendered by the internal counter 433. It should be noted that because the internal counter 433 stores the kept time, the time indicated by the counts of the internal counter 433 will match the time indicated by the hands if the internal counter 433 and hands are synchronized. The internal counter 433 therefore also functions as a hand position counter indicating the positions of the hands when the internal counter 433 is synchronized with the hands.

The time adjusting means 440 is connected to the reception means 420, frequency divider 432 and internal counter 433 of the timekeeping means 430, control circuit 470, and drive signal generator 450. The time adjusting means 440 contains current time memory 441. The current time memory 441 is composed of counters, such as preset counters for storing the time code. When the control circuit 470 detects the operation detection signal output by the external operating member detection circuit 410 when it detects a specific input operation of the crown 300, the control circuit 470 applies a specific signal to the time adjusting means 440, causing it to store the time code acquired by the reception means 420 to the current time memory 441. Similarly to the internal counter 433, the current time stored to this current time memory 441 is regularly incremented and updated based on the reference signal output from the frequency divider 432. The current time memory 441 therefore always stores the current time data.

Furthermore, when the control circuit 470 detects that, for example, operation was switched from the time-setting position where the displayed time can be changed to the position where the time cannot be changed (that is, detects that the crown 300 was changed from the pulled-out position to the pushed-in position), the time adjusting means 440 sets the seconds value (second count) of the internal counter 433 to 00 seconds.

The time adjusting means 440 compares the seconds value in the current time data stored in the current time memory 441 (that is, the seconds value in the time code acquired by the reception means 420), and the seconds value in the time data kept by the timekeeping means 430 and stored in internal counter 433, and detects the advance or delay in the seconds value of the kept-time data relative to the seconds value of the received current time (that is, detects the time difference).

The time adjusting means 440 also transfers the current time data stored in the current time memory 441 to the internal counter 433 by overwriting the previously stored information, and outputs to the drive signal generator 450 a specific signal set according to the detected time delay or advance (time difference). Though described in further detail below, output of this specific signal enables the drive signal generator 450 to control the time display drive circuit 460 and thereby control the movement to quickly advance or reverse the hands, or stop the movement, to change the hand positions and thereby adjust the time.

If the reception means 420 fails to receive the longwave standard time signal and therefore cannot acquire the time code, the time adjusting means 440 cannot compare the time code information with the counts of the internal counter 433, and therefore does not run the process transferring the received current time data to the internal counter 433 and the process for driving and adjusting the hand positions according to the time difference. More specifically, these processes are not executed until the standard time signal is successfully received.

Whether the received time data is correct, that is, whether the time data was correctly acquired, can be determined by receiving multiple frames (normally two or three frames) of time data transmitted at one minute intervals with a longwave standard time signal, and detecting if the time data in the received frames indicates a known time difference. For example, if the time data is from consecutive frames, whether the time data is correct is determined by detecting if the consecutive frames denote times at one minute intervals.

The drive signal generator 450 is connected to the frequency divider 432 and internal counter 433 of the timekeeping means 430, the control circuit 470, time adjusting means 440, and time display drive circuit 460. The drive signal generator 450 appropriately controls the time display drive circuit 460 based on the specific signal from the time adjusting means 440, and thereby controls movement of the hands.

The time display drive circuit 460 controls the driving of the drive means. The time display drive circuit 460 drives the drive means based on the pulse signal output from the drive signal generator 450.

More specifically, the hands are moved as a result of a 1 Hz pulse signal being applied. In other words, the second hand turns 6°, the distance of one second, and in conjunction with rotation of the second hand, the minute hand 230 and hour hand 220 also turn. When a fast-advance pulse signal of 128 kHz, for example, is applied, the drive means is driven based on this fast-advance pulse signal so that the hands advance quickly.

The external operating member detection circuit 410 is connected to the control circuit 470, which acquires a specific signal from the external operating member detection circuit 410 when it detects a specific input operation of the crown 300, and the control circuit 470 thereby recognizes that a specific input operation was performed. More specifically, when the crown 300 is pulled out, the control circuit 470 sets the time-adjustment mode to the state enabling the time indicated by the time display means 200 to be changed by an input operation of the user. When the crown 300 is pushed in, the control circuit 470 sets (cancels) the time-adjustment mode to the state in which the indicated time cannot be changed by an input operation of the user. For example, if a time-adjustment mode setting of "1", for example, denotes the state in which the time can be set, and "0" denotes the state in which the time cannot be set by the user, the control circuit 470 sets the time-adjustment mode flag to "1" when the crown 300 is pulled out, and sets it to "0" when the crown 300 is pushed in.

When the time-adjustment mode is changed from enabling to disabling manually adjusting the time, the control circuit 470 applies various control steps for adjusting the time. More specifically, when the control circuit 470 detects the specific input operation denoting that the crown 300 was pushed in, it controls the frequency divider 432 to appropriately reset the frequency dividing process. That is, by resetting the frequency dividing process of the frequency divider 432 when the crown 300 is pushed in, the received time data and timekeeping by the radio-controlled timepiece 100 are substantially synchronized.

The control circuit 470 also controls the reception means 420 to appropriately receive time data.

The control circuit 470 also executes a process for storing the received time data to the current time memory 441 of the time adjusting means 440, and instructs the time adjusting means 440 to run a time-adjustment process. The control circuit 470 also controls the appropriate outputting of a specific pulse signal from the drive signal generator 450 to the time display drive circuit 460.

Operation of a Radio-controlled Timepiece

(Setting the Time at First use)

The time setting operation of the radio-controlled timepiece 100 configured as described above is described first below based on the accompanying figures with reference to the operation for setting the time when the timepiece is first used. This "first use" as used herein refers to when the timepiece is first used and it has not even once set the time by receiving the standard time signal, and also refers when a battery is loaded into the timepiece or replaced.

Figure 2:
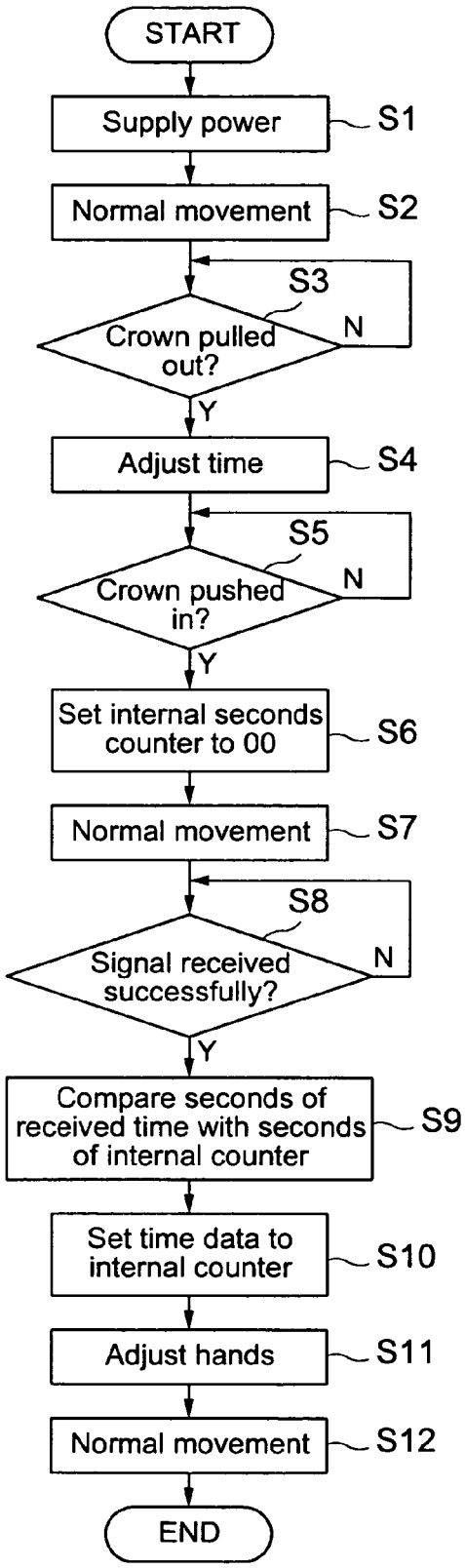
FIG. 2 is a flow chart showing the time adjustment operation at first use.

FIG. 2 is a flow chart of the operation for setting the time when the radio-controlled timepiece 100 is first used. FIG. 3 describes the time-setting operation when the time is adjusted to the current time. FIG. 4 describes the time-setting operation when the time is set delayed 5 seconds from the current time. FIG. 5 describes the time-setting operation when the time is set advanced 15 seconds from the current time. FIG. 6 describes the time-setting operation when the time is set delayed 40 seconds from the current time to describe the action of the present embodiment. FIG. 7 describes the time-setting operation when the time is set advanced 40 seconds from the current time to describe the action of the present embodiment.

When a battery, for example, is loaded as the power source for driving the radio-controlled timepiece 100 at the first use of the radio-controlled timepiece 100, power supplied from the battery (step S1) enables the timekeeping means 430 to start keeping the time (step S2) as shown in FIG. 2. This also happens when the battery is replaced.

When the power supply starts with this first use, the internal counter 433 is initialized to 00:00:00, and a reference signal applied from the frequency divider 432 causes the internal counter 433 to start counting (keeping time). Note that when the internal counter 433 is thus initialized, the hands could be set to any time position and normally do not match the initialized values (00:00:00) of the internal counter 433. As a result, the counts of the internal counter 433 are not synchronized with the positions of the hands. In this state, therefore, even if the standard time signal is received and the time data for the current time (JST) is acquired, and the counts of the internal counter 433 are increased or decreased to match the time data of the current time, and the hands are driven according to the increase or decrease in the counts to adjust the time indicated by the hands, the adjusted time indicated by the hands will not be the current time denoted by the received time data.

At first use, the user therefore manually adjusts the indicated time to the current time because the likelihood is high that the time indicated by the time display means 200 differs from the current time. That is, the user pulls the crown 300 out to set the mode enabling the displayed time to be changed. The operation of pulling out the crown 300 is basically performed when the second hand 240 is pointing to a specific time, preferably the 0 second (that is, to the 0:00 or 12:00 position). This specific time shall not be limited to the 0:00 or 12:00 position, however, and could be any position such as the 30 second position, and can be desirably predetermined.

The external operating member detection circuit 410 detects that the crown 300 was pulled out (step S3) and outputs a specific operation detection signal to the control circuit 470. This causes the control circuit 470 to enable the time-adjustment mode (step S4).

In this time-adjustment mode of step S4 the control circuit 470 runs a process to control the drive signal generator 450 and cause it to stop driving the drive means of the time display drive circuit 460. That is, the control circuit 470 runs a process stopping output from the drive signal generator 450 to the time display drive circuit 460, and thereby stops the 1-Hz pulse signal that drives the drive means that move the hands. The internal counter 433 could continue counting the reference signal or could stop counting while the hands are being adjusted.

When the crown 300 is pulled out and the user then turns the crown 300, the hands (hour hand 220, minute hand 230) turn in conjunction with rotation of the crown and can be reset to the current time.

The operation of adjusting the hands to the current time is described in detail below, but basically involves checking the current time from a known source, such as the television or telephone, for example, and turning the crown 300 according to this time information to adjust the positions of the hour hand 220 and minute hand 230. As noted above, the second hand 240 is preferably stopped at a predetermined position (such as the 0 or 30 second position).

Once the time indicated by the hour hand 220, minute hand 230, and second hand 240 is the current time, the crown 300 is pushed in to start the movement. As a result, the time indicated by the hands and the current time will match even if the time denoted by the counts of the internal counter 433 and the time indicated by the hands do not match. It should be noted that the timing at which the crown 300 is pushed in may differ by some seconds from the current time and the time indicated by the hands may differ from the current time by some seconds, but as further described below this error can be automatically corrected by the present embodiment of the invention if the time indicated by the hands is within +/−3 seconds of the current time. More specifically, the user does not need to correctly set the time to the second, but only needs to set the time and push the crown 300 in within +/−3 seconds of the current time.

After the user turns the crown 300 to set the time to the current time at step S4, and then pushes the crown 300 in such that the time cannot be manually changed, the external operating member detection circuit 410 detects that the crown was pushed in as a specific input operation (step S5) as shown in FIG. 2, and outputs a specific operation detection signal. When the control circuit 470 detects the specific operation detection signal from the external operating member detection circuit 410, it clears the time-adjustment mode, resets the frequency dividing process of the frequency divider 432, and sets the seconds value of the internal counter 433 to a specific value of 00 seconds corresponding to a predetermined time (step S6). The second hand 240 and seconds value (second counter) of the internal counter 433 thus now both indicate 0 seconds, and are thus synchronized.

The control circuit 470 starts keeping the time (step S7) from the moment the seconds value in the internal counter 433 is set to 00 seconds in step S6. That is, the control circuit 470 starts counting up the counts of the internal counter 433 based on the pulse signal from the frequency divider 432, and instructs the drive signal generator 450 to output the pulse signal to the time display drive circuit 460 in order to move the hands.

Specifically, if the current time acquired by the user from a time announcement, for example, is 1:21 to 1:22 and some seconds, the user pulls the crown 300 out and stops the movement when the second hand 240 points to 0:00 (12:00). The user then turns the crown 300 to reset the hour hand 220 and minute hand 230 to 1:23, that is, a time advanced from the current time. The user then pushes the crown 300 in to start the movement when the announced current time reaches 1:23:00.

The actual time at which the crown 300 is pushed in could be +/−30 seconds of the current time. The user therefore does not need to push the crown 300 at precisely second 0 of the announced current time, and only needs to push the crown 300 in within +/−3 seconds of the current time.

The time indicated by the hands can be adjusted to the current time even if, for example, the user set the hands to 1:23:00 and intended to push the crown 300 in when the time announcement signaled 1:23:00, but actually pushed the crown 300 in 5 seconds late (−5 seconds), that is, pushed the crown 300 in when the current time was actually 1:23:05, as shown in FIG. 4.

The time indicated by the hands can also be adjusted to the current time if, as shown in FIG. 5, the crown 300 is pushed in 15 seconds earlier than the current time (a 15 second advance, +15 seconds), that is, if the crown 300 is pushed in when the current time is actually 1:22:45.

The internal counter 433 is also initialized to 00:00:00 when the battery is replaced. In the examples shown in FIG. 3 to FIG. 7 the crown 300 is operated and pushed in approximately 3 minutes after the internal counter 433 is initialized, and because the seconds value of the internal counter 433 is set to a specific count (00 seconds) when the crown 300 is pushed in, the internal counter 433 is set to 00:03:00 when the time is changed using the crown.

Note that in each of these cases the user pulls the crown 300 out when the second hand 240 is at the 0 second position, and then adjusts the hour hand 220 and minute hand 230. When the crown 300 is then pushed in, the seconds value of the internal counter 433 is set to 00 seconds. As a result, the second hand 240 and seconds value (seconds counter) of the internal counter 433 both indicate 0 seconds and therefore match.

On the other hand, while the seconds value of the second hand 240 and internal counter 433 and the seconds value of the current time match as shown in FIG. 3 if the crown 300 is pushed in timed to the 0 second of the time announcement as described above, they will not match if the crown 300 is pushed in offset either before or after the 0 second of the time announcement.

The time data is also not recognized at this time because the longwave standard time signal has not been received.

After starting the movement in step S7, the control circuit 470 then controls the reception means 420 to receive the longwave standard time signal and acquire the time data. It should be noted that this acquisition of time data is not limited to being driven by operation of the crown in step S5. Instead, driving the movement started in step S7 could continue until the scheduled time signal reception, that is, the movement could continue keeping time until the scheduled reception time with the error introduced when the time was set, at which time the same operation described below is performed.

The time adjusting means 440 then determines if the longwave standard time signal was received or not by the reception means 420, or more specifically, whether the time data was received or not (step S8).

The reception process is repeated if in step S8 it is determined that the time data could not be correctly received and the current time could not be stored to the current time memory 441. This reception process shall not be limited to the case executed immediately after it is determined that the time data could not be correctly received, and the movement could be driven to continue keeping time from step S7 with time signal receiving repeated after waiting a predetermined time. In this case the timepiece operates similarly to a conventional quartz watch.

On the other hand, if in step S8 the time adjusting means 440 determines that the time data was successfully acquired at the first reception try after the crown 300 was pushed in, the time adjusting means 440 stores the acquired time data to the current time memory 441. The time adjusting means 440 then compares the seconds value of the stored current time with the seconds value of the count maintained by the internal counter 433, and thereby detects any difference in the count to the current time, that is, the advance or delay of the second hand 240 to the current time (step S9).

If, for example, the current time at which the time data was acquired (the successful reception time) was 1:43:00 as in the example shown in FIG. 3 in which the time indicated by the hands is adjusted to the current time, the time (hand position) indicated by the positions of the hands will match the received time data and the current time because the movement is started and timekeeping starts with the operation shown in step S5 at the moment the time data is acquired. Note that the internal counter 433 is also advanced to denote 00:23:00. Because the count of the seconds value of the internal counter 433 is also set to a predetermined value (00 second) in step S6 to match the second hand 240 and current time, the seconds value of the internal counter 433 also denotes 00 seconds when reception succeeds, and the seconds value is the same in the indicated time (hand position), the received time data, and the current time. The minute and hour values of the internal counter 433 counts are not synchronized, however, and therefore are not the same in the indicated time (hand position), received time data, and current time.

Therefore, when the time adjusting means 440 compares the 00 second value of the received time data and the 00 second value of the counter in step S9, the time difference between the seconds value of the current time, that is, the received time data, and the seconds value kept by the internal counter 433, that is, the timekeeping means 430, is therefore 0, and the time adjusting means 440 knows that the seconds value is neither delayed nor advanced.

Furthermore, in the example shown in FIG. 4 in which the time is set with a 5 second delay, the successful reception time is again 1:43:00, and the time indicated by the hands is likewise delayed and shown as 1:42:55. The internal counter 433 is also likewise delayed and denotes 00:22:55. When the time adjusting means 440 then compares the 00 seconds value of the received current time and the 55 seconds count of the counter, it detects a 5 second delay (−5 seconds) in the seconds count based on a difference within +/−3 seconds.

Furthermore, if the current time when signal reception is successful is 1:43:50 in the example in which the time is set with a 15 second advance as shown in FIG. 5, for example, the time indicated by the hands is 1:44:05, that is, the same time as in the FIG. 3 example, and the count of the internal counter 433 is counted up to 00:24:05. When the time adjusting means 440 then compares the 50 second value of the current time with the 05 second value denoted by the counter, it knows that the seconds value of the counter is advanced 15 seconds (+15 seconds) based on a difference within +/−3 seconds.

After step S9, the control circuit 470 transfers the time data stored as the current time in the current time memory 441 of the time adjusting means 440 to the corresponding second count, minute count, etc. of the internal counter 433 (step S10). As a result of step S10, the current time and the counts of the internal counter 433 match. That is, at least the second, minute, and hour counts (that is, the counts for the time data extracted from the received time data) are correctly stored. If the internal counter 433 can also count calendar information such as the date, day, month, and year, and not just the hour, minute, and second time data, this time data and calendar data is all rewritten to the correct counts extracted from the received current time data.

More specifically, in the examples shown in FIG. 3 and FIG. 4, this process stores the received time data of 1:43:00 to the internal counter 433, and in the example shown in FIG. 5 it stores received time data 1:43:50.

The control circuit 470 controls moving the hands appropriately to adjust the time indicated by the hands to the time of the time data denoting the current time by means of the time adjusting means 440 (step S11).

More specifically, the time adjusting means 440 outputs a signal corresponding to the delay or advance detected in step S9 to the drive signal generator 450. Based on this signal corresponding to the detected delay or advance, the drive signal generator 450 outputs a specific fast-forward pulse signal or fast-reverse pulse signal, for example, to the time display drive circuit 460. Based on the acquired fast-forward pulse signal or fast-reverse pulse signal, the time display drive circuit 460 then drives the drive means and moves the hands. More specifically, it rapidly advances or reverses the hands to adjust the time indicated by the hands to the current time.

In the case shown in FIG. 3, for example, no delay or advance of the hands is detected. The process for outputting the specific fast-forward pulse signal or fast-reverse pulse signal, for example, to the time display drive circuit 460 is not executed, and this process of moving the hands is not run (i.e., there is no need to adjust the hands).

Furthermore, when the time is set with an incorrect 5 second delay as shown in FIG. 4, the hands are detected to be positioned 5 seconds slow. The time adjusting means 440 therefore instructs the hands to advance 5 seconds, and adjusts the hands to indicate 1:43:00 (the hands are automatically adjusted).

Furthermore, when the time is incorrectly set with an advanced of 15 seconds as shown in FIG. 5, the hands are detected to be positioned 15 seconds ahead, i.e. 15 seconds fast. The time adjusting means 440 therefore instructs the hands to reverse 15 seconds, and adjusts the hands to indicate 1:43:50 (the hands are automatically adjusted).

The result of step S11 is that the positions of the hands match the counts of the internal counter 433, which were corrected to the current time based on the time data in step S10. That is, the counts of the internal counter 433, the positions of the hands, and the time data denoting the current time all match.

The normal movement control process then takes over so that, based on the pulse signal output from the frequency divider 432, the drive means is driven by way of the drive signal generator 450 and time display drive circuit 460 and moves the hands one second at a time, the internal counter 433 counts up one second at a time, and the current time is kept with the counters and hands synchronized (step S12), and the time adjustment process ends.

After this time adjustment process ends, the control circuit 470 controls the reception means 420 to regularly receive the longwave standard time signal, acquires the time data for the current time based on the received longwave standard time signal, and compares the seconds value of the current time with the seconds value of the internal counter 433 as described above in the time adjusting process. Based on the detected time difference, the control circuit 470 adjusts the time by appropriately moving the hands so that the counts of the internal counter 433 match the time data. More specifically, a time adjustment operation is run as in a conventional radio-controlled timepiece to adjust the time indicated by the hands to the current time. Because the hand positions are synchronized with the internal counter 433 at this time, steps S9 and S10 are not required. More specifically, steps S9 and S10 are executed only at the time the standard time signal is first received when the crown 300 is pushed in after it is pulled out, and when the standard time signal is received as part of the subsequent normal movement control (step S12), the displayed time is adjusted to the current time using the same time adjustment procedure performed in a common radio-controlled timepiece.

If the hands and internal counter 433 are synchronized, the hour, minute, second, and calendar data can also be compared rather than just the seconds value, and adjusted appropriately as needed.

What happens in the above time adjustment process when the user sets the time based on a time announcement but inadvertently changes the time to a difference greater than +/−3 seconds is described next with reference to FIG. 6 and FIG. 7.

In the example shown in FIG. 6, the user pulls the crown 300 out to stop the movement when the second hand 240 points to 0:00 (12:00) as described above based on the current time acquired from a time announcement, and changes the time to 1:23:00. The user then inadvertently pushes the crown 300 in when the current time is 1:23:40, and thus starts the movement when the hands are delayed 40 seconds (−40 seconds), that is, a delay of +/−3 seconds or greater to the current time.

In the case shown in FIG. 7, the user likewise pulls the crown 300 out and stops the movement when the second hand 240 points to 0:00 (12:00) based on the current time acquired from a time announcement, for example, and changes the time to 1:23:00. The user then inadvertently pushes the crown 300 in when the current time is 1:22:20, and thus starts the movement when the hands are advanced 40 seconds (+40 seconds), that is, an advance of +/−3 seconds or greater to the current time.

Note that the cases shown in FIG. 6 and FIG. 7 assume that the internal counter 433 registers 00:03:00, for example, when the crown 300 is pushed in. Furthermore, because the longwave standard time signal has not been received, time data has not been acquired.

If the current time of the received time data in step S8 is 1:42:00 in the example shown in FIG. 6 in which the time is set 40 delayed from the current time, then the time indicated by the hands will show 1:41:20 and the counts of the internal counter 433 will have 00:21:20. If the time adjusting means 440 compares the 00 seconds of the current time with the 20 second count of the internal counter 433, it evaluates the difference based on a difference of within +/−3 seconds and thereby detects that the seconds count is a 20 second advance (+20 seconds). This is because when calculating the time difference of the seconds value kept in the internal counter 433 to the seconds value of the current time, the time adjusting means 440 assumes that the seconds value of the internal counter 433 is within +/−3 seconds of the seconds value of the current time.

On the other hand, if the current time of the received time data in step S8 is 1:43:50 in the case shown in FIG. 7 in which the time is set 40 seconds fast, the hands will indicate a time of 1:44:30 and the internal counter 433 will have 00:24:30. If the time adjusting means 440 then compares the 50 seconds of the current time with the 30 seconds value of the counter, it again assumes that the difference is within +/−3 seconds, and therefore incorrectly determines that the seconds value of the counter is delayed 20 seconds (−20 seconds).

Therefore, when the time is adjusted in step S11 in the FIG. 6 example where the time is set 40 seconds slow, the movement is controlled to further delay the time by an additional 20 seconds because the hands are incorrectly determined to be advanced 20 seconds. The hands are therefore changed to 1:41:00 even though the current time is 1:42:00, and the current time and the counts of the internal counter 433 no longer match.

On the other hand, in the FIG. 7 example in which the time is set 40 seconds fast, the hands are incorrectly determined to be 20 seconds slow, and the movement is therefore controlled to further advance the hands an additional 20 seconds. The hands are therefore adjusted to indicate 1:44:50 even though the current time is 1:43:50, and the current time and the counts of the internal counter 433 no longer match.

In this way, because the current time has already been transferred to the internal counter 433 in step S10, the time indicated by the hands and the counts of the internal counter 433 no longer match and cannot synchronize.

When the user recognizes that there is an error of approximately one minute, and then repeats the process from step S3 to change the indicated time to within +/−3 seconds of the current time, the time can be correctly adjusted as described above with reference to FIG. 3 to FIG. 5.

Practical Benefits of this Radio-controlled Timepiece

The preferred embodiment of the invention described above affords the following operational benefits.

(1) When the external operating member detection circuit 410 detects the specific input operation of the crown 300 (pushing the crown 300 in), the time adjusting means 440 sets the count of the seconds value in the time kept by the timekeeping means 430 to denote 00 seconds. The internal counter 433 continues counting based on the reference signal from the frequency divider 432. When a standard time signal is received, the control circuit 470 detects the time difference of the seconds value in the internal counter 433 to the seconds value in the received time data, and based on this time difference adjusts the hands, and more specifically the second hand 240, and sets the received current time data in the internal counter 433.

Therefore, by using the crown 300 to manually set the hour, minute, and seconds values of the time displayed by the hands on the time display means 200 to the current time denoted by the time data, for example, the time indicated by the hands and the counts kept by the internal counter 433 can be easily synchronized without also setting the hour and minute values of the counts kept by the internal counter 433, and it is not necessary to use a configuration having sensors for detecting the hand positions. Timepiece construction can therefore be simplified, and manufacturability and productivity can be easily improved. Moreover, the operation for setting the time is simple and the time can be easily adjusted because the displayed time is adjusted in the same way it is done on a conventional quartz watch, that is, the crown 300 is manipulated to turn the hour hand 220 and minute hand 230 and set the time based on a time announcement, for example. Moreover, a configuration for synchronizing the time indicated by the hands and the kept time is easily afforded.

(2) The driving of the drive means is controlled to move the hands and set the current time based on the time difference between the 00-seconds count of the seconds value set in the internal counter 433 and the seconds value in the received time data.

As a result, a common conventional time adjustment configuration can be used to set the time, and the time can be easily adjusted. More particularly, if when manually setting the hands to the current time the timing at which the crown 300 is pushed in is offset slightly from the actual time but is within +/−30 seconds, the second hand 240 can be automatically corrected to the correct second when the standard time signal is then received. That is, if the time difference is within −3 seconds, the set time is determined to be delayed from the current time by that difference, and if the time difference is within +30 seconds, the set time is determined to be advanced from the current time by that difference. The time (second hand 240) is then automatically adjusted based on the result of this determination. As a result, precise timing is not needed to manually set the time, and the user can easily manually operate the timepiece. While the hour hand 220 and minute hand 230 cannot be automatically corrected, it is the second hand 240 that is easily set out of step when the crown 300 is pushed in, and the likelihood that the time indicated by the hands shifts is very small.

(3) The time can be set with an extremely simple operation because the hands and internal counter 433 are synchronized and the time indicated by the hands can be automatically adjusted by manually adjusting the hands to the current time and pushing the crown 300 in. That is, when the timepiece does not have a hand position sensor, it is conventionally necessary to move the hands to a specified position (such as 00:00:00) and synchronize to the internal counter 433, but adjusting the hands in this manner is inconvenient. With the present embodiment, however, the hands can be simply set to the current time, and because the time indicated by the hands is not particularly different from the current time when a new battery is inserted because, for example, the capacity of the old battery was low and the battery needed replacing, the hands can easily reset to the current time. The ease and convenience of adjusting the time are therefore improved.

Moreover, when the hands are moved to a specified position as with a conventional mechanism, the standard time signal is received, and the hands are moved to the current time, the hands typically move a great distance. This means that the motor is driven for a relatively long time to move the hands, and power consumed to adjust the time increases. With the present embodiment, however, the hands are automatically adjusted by moving the second hand 240 only slightly, and power consumption is therefore significantly reduced.

Second Embodiment

A second embodiment of the present invention is described next with reference to FIG. 8 to FIG. 12.

In the above-described first embodiment only the seconds value of the internal counter 433 is set to a predetermined value, that is, 0 seconds in the above embodiment, when the [crown] 300 that is an external operating member is pushed in and this operation is detected by the external operating member detection circuit 410. In the present embodiment, however, the seconds value is also not set to a predetermined value when this operation is detected. Specifically, control continues without setting any of the time data values (that is, the year, month, date, day, hour, minute, second) in the internal counter 433 to a predetermined value.

The construction of the radio-controlled timepiece 100 according to this second embodiment of the invention is the same as the construction of the first embodiment shown in FIG. 1. This second embodiment differs in that the function of the time adjusting means 440 for setting the seconds value to a specific value in the first embodiment is not provided in this second embodiment.

In addition, the radio-controlled timepiece 100 of the present embodiment is configured so that it can also display calendar information such as the year, month, date, and day, and to achieve this a ROM (read-only memory) not shown is disposed in the control circuit 470, for example, and calendar data is stored in this ROM. This enables processing the end of the month so that the next date is automatically correctly set to the first at the end of short months having only 30 days, and the end of February can be correctly processed in leap years.

It will be obvious that the same ROM could be rendered in the first embodiment so that the year, month, date, and day can also be displayed.

Figure 8:
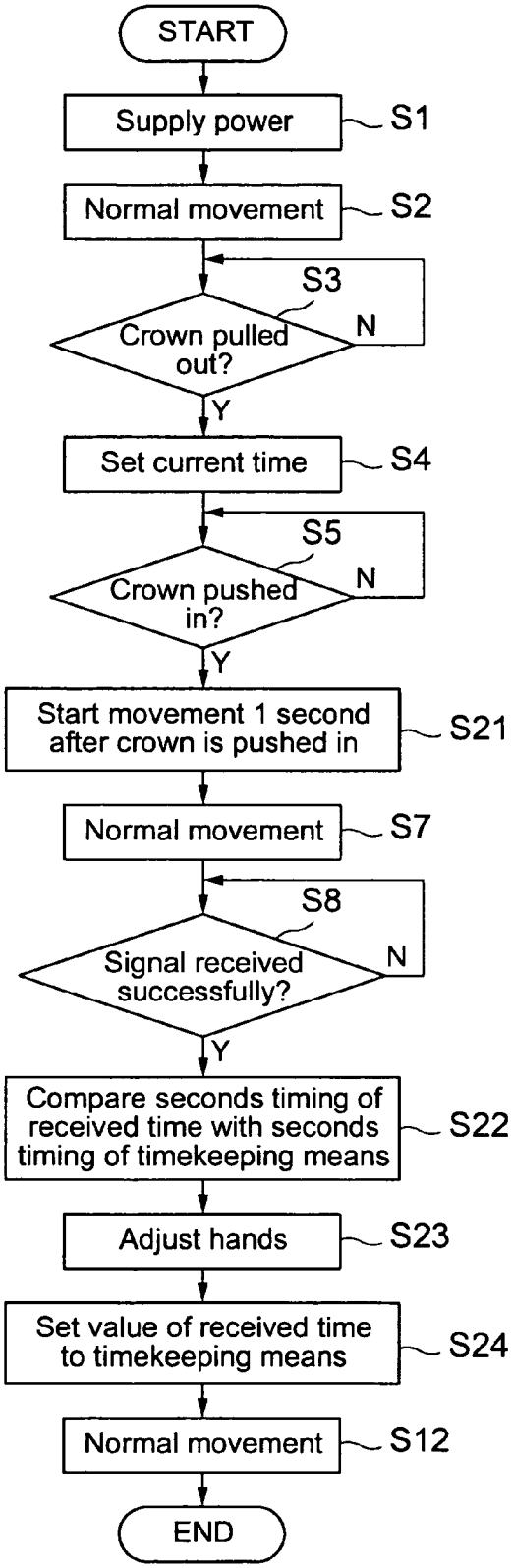
FIG. 8 is a flow chart describing the time adjustment operation at first use of a second embodiment of the invention.

Setting the hands and the operation of a radio-controlled timepiece 100 according to this embodiment of the invention are described below with reference to the flow chart in FIG. 8 and the table shown in FIG. 9. It should be noted that steps performing the same or similar process in FIG. 8 and FIG. 2 are identified by the same reference numerals, and further description thereof is omitted below.

As in the first embodiment, the internal counter 433 is initialized to predetermined counts when power is supplied as a result of loading a battery (step S1). In the present embodiment the year value is initialized to 2000, the month value to January, the date value to the 1st, the day value to Sunday, the hour value to 0, the minute value to 0, and the seconds value to 0.

The timekeeping means 430 then starts keeping time and normal movement of the hands commences (step S2).

Because the hands may be pointing in any direction at this time, the time indicated by the internal counter 433 (the internal counts) will normally not match the time indicated by the hands and will not be synchronized.

As in the first embodiment, the user then manually sets the time. That is, the user pulls out the crown 300 so that the time indicated by the hands can be changed.

The external operating member detection circuit 410 detects that the crown 300 is pulled out (step S3) and outputs a specific operation detection signal to the control circuit 470. As a result, the control circuit 470 sets the time-adjustment mode (current time setting mode) (step S4).

As in the first embodiment, in this time-adjustment mode of step S4 the control circuit 470 controls the drive signal generator 450 to stop driving the drive means of the time display drive circuit 460. The internal counter 433 could continue counting the reference signal or could stop counting while the time is being set.

With the crown 300 pulled out, the user turns the crown 300 to adjust calendar information such as the year, month, date, and day, and set the hands (hour hand 220, minute hand 230, second hand 240) to the current time, and then after the time indicated by the hands matches the current time, pushes the crown 300 back in (step S5). When the crown 300 is pushed in in the example shown in FIG. 9, the internal counter 433 indicates the passage of 3 minutes 20 seconds since the counter was initialized after the battery was replaced. The hands, however, match the current time (2003 Jul. 11, Friday, 01:43:00) because the user has set the hands to the current time.

Note that the second hand 240 usually cannot be manually adjusted by turning the crown 300 in a radio-controlled timepiece 100. As a result, the user must listen to a time announcement, for example, to turn the crown 300 and adjust the hour hand 220 and minute hand 230, and then push the crown 300 in at the moment the time indicated by the hands matches the current time. As a result, the crown 300 is typically preferably pulled out in step S3 when the second hand 240 is positioned at the full minute (0 seconds), or at the 10, 20, 30, 40, or 50 second position so that the crown 300 can be easily pushed in, in step S5, and synchronized to the time announcement.

When the crown 300 is pushed in (step S5), the external operating member detection circuit 410 outputs a specific operation detection signal. The control circuit 470 cancels the time-adjustment mode when it detects this specific operation detection signal from the external operating member detection circuit 410, resets the frequency dividing process of the frequency divider 432, and starts the movement (step S21). Because the second hand 240 is stepped each second in the present embodiment, the movement can start and the second hand 240 can be moved by the distance of one second one second after the crown 300 is pushed in.

As described above, the current time and the time indicated by the hands match when the movement starts because the user had manually set the hands. The time indicated by the hands and the internal counter 433 do not match, however.

Thereafter, the control circuit 470 controls the movement as usual (step S7). That is, the control circuit 470 causes the internal counter 433 to count up based on pulse signals from the frequency divider 432, instructs the drive signal generator 450 to output pulse signals to the time display drive circuit 460, and thereby moves the hands.

After the movement process in step S7, the control circuit 470 controls the reception means 420 to receive the longwave standard time signal and acquires the time data. Note that this acquisition of time data can occur immediately after the movement is started in step S7, or at the normally scheduled reception time.

To improve the reception sensitivity of the reception operation, the movement is preferably stopped so that the motor does not affect RF reception by the antenna. It is therefore possible to immediately receive the standard time signal after the crown 300 is pushed in without starting the movement, and start the movement after signal reception is successful. Because the hands are set to the current time in step S4 and then remain stopped at that position when the crown 300 is pushed in, the hands will be delayed from the current time by the time required for the time signal reception operation to complete. Therefore, the internal counter 433 could measure the elapse time from when the crown 300 is pushed in until signal reception is completed, and then drive the hands by that elapse time.

Instead of receiving the time signal immediately after the crown 300 is pushed in, the movement could be driven in step S7 until the next scheduled reception time. That is, the time could be kept with the error introduced when the time was set, and the hands can then be adjusted when the time data is received at the regularly scheduled reception time.

The time adjusting means 440 then determines if the longwave standard time signal was successfully received by the reception means 420, that is, whether the time data was successfully acquired (step S8).

As also described in the first embodiment, the time adjusting means 440 is controlled to repeat the time signal reception operation in step S8 when reception fails and the time data is not correctly acquired.

If, on the other hand, the time adjusting means 440 confirms that the time data was acquired in step S8, the time adjusting means 440 stores the acquired time data to the current time memory 441.

The time adjusting means 440 also compares the timing of the seconds value in the received time data with the timing of the seconds count of the timekeeping means, that is, the input timing of the signal output at 1-second intervals by the frequency divider 432, and detects the difference therebetween (step S22).

More specifically, as shown in FIG. 10, the standard time signal is a series of pulse signals transmitted at 1-second intervals where a pulse width of approximately 0.2 second denotes a marker or position marker, a pulse width of 0.8 second denotes a binary 0, and a pulse width of 0.5 second denotes a binary 1. The rising edge of each pulse signal therefore occurs at 1-second intervals. The signals output from the frequency divider 432 are also pulse signals at 1-second intervals. Therefore, the difference in the seconds timing can be determined by detecting the time difference □t at the rising edge of each pulse signal.

More specifically, the time adjusting means 440 detects the time difference □t between the pulse signal detected within +/−0.5 second of the beginning of the standard time signal (the 0 second position), and the 0 second (marker) of the standard time signal, and adjusts driving the hands, and particularly the second hand 240, so that this time difference is eliminated (step S23).

This adjustment results in the movement of the second hand 240, that is, the hands, matching the actual time.

The time adjusting means 440 then transfers the received time data to the internal counter 433 of the timekeeping means 430 (step S24). While the hand positions and counts of the internal counter 433 did not previously match, this adjustment synchronizes the time indicated by the hands (the hand positions) to the counts of the internal counter 433. More specifically, the counts of the internal counter 433, the positions of the hands, and the time data denoting the current time are now all synchronized.

The Japan Standard Time signal JST, for example, is transmitted once every 60 seconds (60 bits/frame). It can therefore be determined that the correct time data was received if consecutive signals are received for 3 minutes (3 frames), and the times indicated by the respective signals are at 1-minute intervals. Because the hour and minute data in this standard time signal are contained in the first 20 seconds of the frame, the hour and minute data can be extracted and whether reception was successful or not can be determined when the first 20 seconds of the third signal are received when receiving three consecutive signals. The seconds timing can therefore be compared and the hand adjustment process run while the part of the third signal from second 20 to second 60 is being received. Furthermore, because the 0 second (60 second) of the standard time signal denotes the full minute (second 0 of each minute) and the hour and minute data of that full minute are output in the subsequent signals, this embodiment of the invention adds 1 minute to the minute value of the third frame, and at second 60 of the third frame, that is, at second 0 of the next frame, writes the hour and minute data of the third frame plus 1 minute to the hour and minute counters of the internal counter 433, and writes 0 to the seconds counter.

Figure 9:
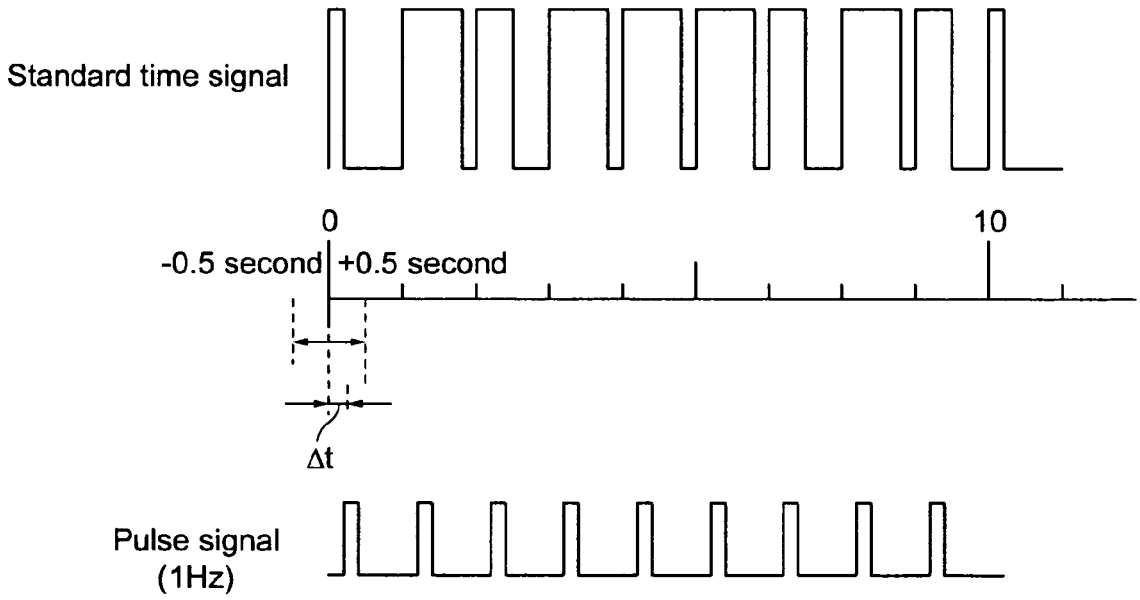
FIG. 9 describes the relationship between the seconds timing of the standard time signal and the seconds timing of the drive signal in the second embodiment of the invention.

Using the example shown in FIG. 9, the current time, the received time data, and the time indicated by the hands all match when signal reception is successful, but the internal counter 433 is not synchronized. The internal counter 433 is therefore adjusted when signal reception is successful so that the current time, the received time data, the time indicated by the hands, and the internal counter 433 are all synchronized to the same time. Note that in the example shown in FIG. 9 the hands are already set to the current time and the hands are therefore not actually adjusted.

On the other hand, if as shown in FIG. 11 the crown 300 is pushed in, in step S5, at a 0.3 second delay to the current time, the time adjusting means 440 processes adjusting of the hands in step S23. However, if the crown 300 is pushed in 0.3 second in advance of the current time in step S5 as shown in FIG. 12, the hands are not adjusted in step S23.

Note that because the second hand 240 is stepped every 1-second, the second hand 240 is adjusted in either case as a result of adjusting the output timing of the drive pulse.

After these processes are completed, normal control of the movement resumes (step S12). That is, the process described above is only run when the internal counter 433 is reset and is not synchronized with the hands, and once the counter and hands are synchronized, the movement can be controlled as usual. That is, the drive means is driven by way of the drive signal generator 450 and time display drive circuit 460 to move the hands in 1-second increments based on the pulse signals output from the frequency divider 432, the counts of the internal counter 433 are counted up in 1-second increments to keep the current time synchronized, and when the standard time signal is received, the received time data is compared with the internal counter 433 counts, and the hands are adjusted to eliminate any detected difference.

This second embodiment of the invention therefore also offers the same practical benefits as the first embodiment in that it also renders a hand position sensor unnecessary, and does not require moving all of the hands to the 12:00 or other predetermined position in order to initialize the internal counter 433.

Furthermore, the timing at which the time is adjusted is less limited in this embodiment compared with the first embodiment, and in this respect therefore offers improved operability. More specifically, when the crown 300 is pushed in in step S5 in the first embodiment, only the seconds value (seconds counter) of the internal counter 433 is initialized to a predetermined value (0 second) in step S6, and the crown 300 must therefore be pulled out in step S3 when the second hand 240 indicates the 0 second.

In this second embodiment, however, the seconds counter is not initialized when the crown 300 is pushed in, in step S5. The crown 300 can therefore be manipulated even when the second hand 240 is not pointing to the 0 second. As a result, it is not necessary to wait until the second hand 240 points to the 0 second in order to operate the crown 300, and operability is improved commensurately.

It should be noted that in place of the internal counter 433 not being initialized in this embodiment, the user must set the hands precisely to the current time and only a time difference of up to +/−0.5 second can be automatically corrected. However, because the position of the second hand and the seconds counter value are synchronized in the first embodiment, the first embodiment offers the advantage of being able to automatically adjust the hands to the correct time even if the crown 300 is pushed in offset between +30 seconds and −3 seconds from the current time.

Other Embodiments

The present invention shall not be limited to the first and second embodiments described above, and variations and improvements capable of achieving the object of the invention are also included in the scope of the present invention.

More specifically, the radio-controlled timepiece 100 of the present invention could be a timepiece that does not have a second hand or a calendar function as described above.

Furthermore, the radio-controlled timepiece 100 could be a portable timepiece such as a wristwatch or pocket watch, or it could be a wall clock or mantle clock or other stationary timepiece.

Furthermore, the timepiece is described as being driven by a battery 111 above, but could be configured using other types of power sources, including commercial AC current, solar battery, or body heat. It should be noted that a spring-driven movement may not produce sufficient power to receive the longwave standard time signal, and a battery-driven design that can produce sufficient power and is suitable for watches is preferable.

The time adjusting means 440, control circuit 470, and other circuits and operation means shown in FIG. 1 and mounted on a circuit board to perform the operations shown FIG. 2 or FIG. 8 shall not be limited to logic devices and other hardware constructions. A computer comprising a CPU (central processing unit) and memory could be provided in the radio-controlled timepiece 100, and specific programs and data (the data stored in the memory devices) could be installed to the computer to perform the functions of the circuits and means described above.

For example, a CPU and memory (ROM or RAM) could be rendered in the radio-controlled timepiece 100 to function as a computer, a specific control program and data could be installed to the memory via the Internet or other communications means, or a recording medium such as CD-ROM or a memory card, the CPU could be operated using this installed program, and the time could be appropriately adjusted by manipulating the crown 300.

To install the particular program to the radio-controlled timepiece 100, the memory card or CD-ROM or other media could be loaded directly to the radio-controlled timepiece 100, or a device for reading such media could be externally connected to the radio-controlled timepiece 100. Furthermore, a LAN cable or telephone line, for example, could be connected to the radio-controlled timepiece 100 to install the program via some communications means, or the program could be installed via a wireless connection by providing the timepiece with an antenna.

If the control program, for example, can be supplied from a recording medium or the Internet or other communications means to the radio-controlled timepiece 100, the functions of the present invention can be achieved by simply changing the program, and the desired control program can be selectively installed when the timepiece is shipped from the factory or by the user. This enables manufacturing radio-controlled timepieces 100 with a variety of control methods by simply changing the program. Parts can therefore be shared, and the manufacturing cost when offering a variety of models can be greatly reduced.

The timekeeping means 430, reception means 420, drive signal generator 450, time display drive circuit 460, time display means 200, and other functional constructions of the radio-controlled timepiece 100 shall not be limited to the embodiments described above, and the means of conventionally known radio-controlled timepieces can be used.

Furthermore, the number of receivable channels and the specific country (region) can also be rendered appropriately to the particular embodiment.

Furthermore, the crown 300 is described with a two-stage operation, that is, when pushed in and when pulled out, but could be configured to operate in three or more stages, such as having a three-stage operation when the timepiece also has a calendar function.

Yet further, the external operating member for changing the time shown in the time display means 200 shall not be limited to a crown 300, and a button or other means could be used. That is, the external operating member detection circuit 410 could detect when a button is pressed, and as a result the time display drive circuit 460 could be appropriately driven to quickly advance or reverse the hands to change the time.

The radio-controlled timepiece 100 having an hour hand 220, minute hand 230, and second hand 240 is described above as adjusting the time when the specific input operation of pulling the crown 300 out when the second hand 240 is aligned to a specific position, that is, 00:00 (12:00), is performed. However, the radio-controlled timepiece 100 could be configured so that when, for example, the specific value of the seconds count of the internal counter is set to 30 seconds, the time is adjusted when the input operation of pulling the crown 300 out when the second hand 240 points to the corresponding 6:00 position is performed.

Furthermore, when the user changes the displayed time based on a time announcement, for example, the time can be adjusted when the crown 300 is pushed in within +/−3 seconds of the actual time even if the seconds value indicated by the second hand 240, which stops when the crown 300 is pulled out, does not match the seconds value of the time announcement.

Moreover, when the timepiece has a calendar mechanism, the content of the calendar data displayed by the calendar mechanism could be adjusted by the drive means based on the time code.

The control features of the first and second embodiments could also be incorporated into a single radio-controlled timepiece 100. When thus comprised the control method could be switched such that, for example, the control method of the first embodiment is executed when only the crown 300 is pushed in, and the control method of the second embodiment is executed when the crown 300 is pushed in while a separately provided button is also depressed.

Furthermore, the invention has been described with a configuration detecting a specific input operation of the crown 300 and setting specific values triggered by this detection operation of the external operating member detection circuit 410, but the invention shall not be so limited and the time difference between the seconds value of the kept time when the time data is received and the seconds value of the received time data could be appropriately detected.

Furthermore, in the second embodiment the time adjusting means 440 sets the hour, minute, and second time data from the received time data to the internal counter 433, but could also set calendar data such as the date and day in the internal counter 433.

The time adjusting means 440 could also be configured to set only calendar data in the internal counter 433. In this case the hour hand 220, minute hand 230, and second hand 240 could be initialized with the internal counter 433 as in the prior art, or a hand position sensor for detecting the hand positions could be provided with control processed accordingly.

Furthermore, when calculating the time difference of the seconds value in the kept time to the seconds value of the received time in the first embodiment, the time difference can be obtained as the (seconds value of the kept time (internal counter 433 count)) minus the (seconds value of the received time). Then, if the result (time difference) is greater than or equal to 0 seconds and less than 30 seconds, the time is determined by this time difference to be advanced, and if the result is greater than or equal to 30 seconds and less than 60 seconds, the time is determined by this time difference to be slow. Based on this determination, the time is then adjusted. This is effectively equivalent to determining whether the seconds value of the kept time is within +/−3 seconds from the seconds value of the received time, and the same control can be applied.

The specific construction and processes employed to achieve the present invention can also be suitably applied to other constructions capable of achieving the objects of the present invention.

Alternative Embodiments

Alternative embodiments of the present invention that can be rendered in combination with the first and second embodiments described above are described next below with reference to FIG. 13 to FIG. 15, though they are rendered singularly.

When, for example, the hand positions and the counts of the internal counter 433 are adjusted to the current time and synchronized as a result of time adjustment by means of the first embodiment or a common conventional time adjustment (using a hand position sensor or a synchronization adjustment of moving the hands to a predetermined position), and the hands then move due to an externally applied shock so that the hands go out of synchronization with the counts of the internal counter 433, and as a result the time indicated by the hands is offset from the current time and an error occurs when the standard time signal is received, or error occurs in the indicated time due to the accuracy of a quartz watch (such as a monthly deviation of +/−15 seconds) because the radio-controlled timepiece 100 is located inside a building or other location where the longwave standard time signal is hard to receive, or the longwave standard time signal cannot be received for a long time due to overseas travel or a trip outside of the reception range, this alternative embodiment adjusts the internal counter and hands to the current time without receiving the standard time signal.

Figure 13:
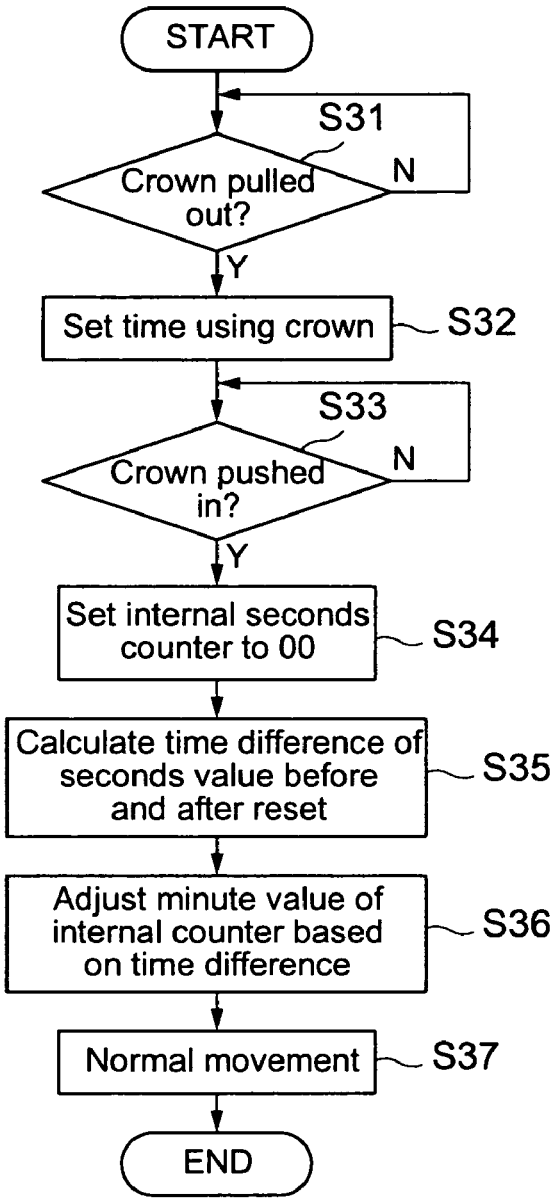
FIG. 13 is a flow chart showing the operation of a radio-controlled timepiece in an alternative embodiment of the present invention.

FIG. 13 is a flow chart of the time adjusting operation of a radio-controlled timepiece 100 according to this alternative embodiment. FIG. 14 describes time adjustment when the time is set with a 4-second delay. FIG. 15 describes time adjustment when the time is set with a 40-second advance to describe the operation of this alternative embodiment. Note that the circuit configuration of this radio-controlled timepiece 100 is the same as that of the first embodiment shown in FIG. 1, and further description thereof is thus omitted.

When the user notices that the time displayed on the time display means 200 is different from the current time, the user manually adjusts the displayed time to the current time. That is, the user pulls the crown 300 out so that the displayed time can be changed. Then, as shown in FIG. 13, the external operating member detection circuit 410 detects the operation of pulling the crown 300 out (step S31), and outputs the specific operation detection signal to the control circuit 470.

As a result, the control circuit 470 assumes the time-adjustment mode (step S32).

As in the first embodiment, the control circuit 470 controls the drive signal generator 450 in this step S32 time-adjustment mode to stop driving the drive means by means of the time display drive circuit 460. That is, the control circuit 470 runs a process to stop outputting the 1-Hz pulse signal for driving the drive means and moving the hands from the drive signal generator 450 to the time display drive circuit 460.

When the crown 300 is pulled out and the user turns the crown 300, the hands are turned in conjunction with rotation of the crown 300 and adjusted to the current time.

For example, if the user recognizes that the time indicated by the hands is 1:21:54 even though the time known from a time announcement is 1:22:00 as shown in FIG. 14, for example, the user knows that there is a 6-second delay (−6 seconds). Note that while the time indicated by the hands and the count of the internal counter 433 are normally synchronized, they may not match if the watch is dropped and the hands skip. In the example shown in FIG. 14 the count of the internal counter 433 is also 1:21:56 and differs by four seconds (−4 seconds) from the current time, and the time indicated by the hands and the current time are not synchronized.

As a result of the user recognizing that the time indicated by the hands differs from the current time, the user stops the movement by means of a specific time-adjustment operation, such as pulling the crown 300 out when the second hand 240 points to a specific time of 00:00 (12:00). The user then turns the crown 300 to change the time indicated by the hands to 1:25:00 based on the current time known from a time announcement, for example.

When the time is thus changed, the count of the internal counter 433 remains delayed 4 seconds from the current time as shown in FIG. 14 even if the time indicated by the hands is corrected to the same time as the current time.

After the user adjusts the hands to the current time in step S32, and then, at the moment the time now indicated by the adjusted hands matches the current time determined from a time announcement as shown in FIG. 14, pushes the crown 300 in to the position where the displayed time cannot be changed, the external operating member detection circuit 410 detects this operation of the crown as the specific input operation (step S33) and outputs the specific operation detection signal. When the control circuit 470 then detects this specific operation detection signal from the external operating member detection circuit 410, it cancels the time-adjustment mode and resets the frequency division process of the frequency divider 432. The control circuit 470 also sets the seconds value of the internal counter 433 to a specified value corresponding to a predetermined time, that is, 00 seconds, thereby synchronizing the counter with the second hand 240 indicating the seconds value of the changed time (step S34).

Using the time adjusting means 440, the control circuit 470 then compares the count (56 seconds) of the seconds value immediately before the counter is reset with the count (00) of the seconds value after the counter is reset.

The time adjusting means 440 thus knows the difference, that is, the advance or delay (time difference), in the count just before the seconds value is reset relative to the count just after the counter is reset (step S35). The control circuit 470 then adjusts the count of the internal counter 433 based on the delay or advance determined by the time adjusting means 440 (step S36).

If, as shown in FIG. 14, for example, the second hand is 6 seconds late and the count is 4 seconds late, the time adjusting means 440 recognizes that the seconds value of the count is delayed 4 seconds (−4 seconds) based on the determination that the count of the seconds value just before the counter reset is a difference within the range of +/−3 seconds. The time adjusting means 440 therefore changes the seconds value of the internal counter 433 from 56 seconds to 00 seconds, and because the difference was determined to be a delay, increases the count of the minute value by one minute so that the counts of the internal counter 433 are set to 01:25:00.

As a result, the counts of the time kept by the internal counter 433, the time indicated by the hands, and the current time based on the time data, are all synchronized.

The drive means is then driven by way of the drive signal generator 450 and time display drive circuit 460 based on the pulse signals output from the frequency divider 432 to move the hands in 1-second increments. The counts of the internal counter 433 are also counted up in 1-second increments so that the current time is kept with the counts synchronized (step S37), and the time-adjustment process ends.

Described next with reference to FIG. 15 is the operation when, in the time-adjustment process shown in FIG. 13 and FIG. 14, the counts of the internal counter 433 differ from the current time of the time data by more than +/−3 seconds when the user has changed the displayed time based on a time announcement, for example.

In the example shown in FIG. 15 the count of the internal counter 433 is delayed 40 seconds to the current time, and the time indicated by the second hand is delayed 42 seconds, that is, the time indicated by the count of the internal counter 433 and the time indicated by the hand are different both from each other and from the current time.

As shown in FIG. 15, this example assumes that the time known to the user from a time announcement, for example, is 1:22:00, and the user pulls the crown 300 out when the second hand 240 points to 0 (12). The user then turns the crown 300 to set the time indicated by the hands to 1:25:00 based on the current time known from a time announcement, for example.

After the time is reset in this case so that the time indicated by the hands is set to the same time as the current time, the count of the internal counter 433 remains delayed 40 seconds to the current time.

The user then pushes the crown 300 in when the adjusted time now indicated by the hands is the same as the current time known from a time announcement. This causes the control circuit 470 to set the seconds value of the internal counter to 00 seconds so that it is synchronized with the second hand 240 indicating the seconds value of the set time.

The control circuit 470 also tells the time adjusting means 440 to compare the count (20 seconds) of the seconds value just before the reset and the count (00 seconds) of the seconds value just after the reset. The time adjusting means 440 then determines the difference, that is, the delay or advance, of the count just before resetting the seconds value to the count just after resetting the seconds value. As noted above, this determination is based on a difference of within +/−3 seconds. Because 20 seconds is compared with 00 seconds, the time adjusting means 440 detects a 20 second advance.

Because the seconds value is already set to 00 seconds and the time adjusting means 440 detected a 20 second advance, it keeps the minute value count set to 24 minutes. As a result, the counts of the internal counter 433 denoting the kept time remain set to 1:24:00 even though the current time and the time indicated by the hands are both 1:25:00, and the kept time thus does not match the current time or the indicated time.

If the time adjustment process is then terminated, the movement will be driven with a difference of one minute in the synchronization between the internally kept time and time actually indicated by the positions of the hands. The method of this alternative embodiment therefore cannot resynchronize the counts kept by the internal counter 433 and the actual current time when the difference therebetween is greater than +/−3 seconds. It is therefore necessary in this case to adjust the time using the method of the first embodiment described above or a conventional synchronization method.

The alternative embodiment described above affords the following benefits.

A specific input operation of the crown 300 causes the time difference between the seconds value of the count counted by the internal counter 433 of the timekeeping means 430 just after the time is changed and the seconds value of the count of the internal counter 433 just before the time was changed to be recognized, and the count kept by the internal counter 433 is then adjusted based on this time difference. More specifically, when the external operating member detection circuit 410 detects a specific input operation of the crown 300, that is, moving the crown 300 from the position whereat the time indicated by the time display means 200 can be manually changed to the position whereat the time cannot be manually changed, the seconds value counted by the internal counter 433 of the timekeeping means 430 is set to a predetermined value, specifically 00 seconds. The time difference between this set predetermined value of 00 seconds and the seconds value count of the internal counter 433 immediately before this specific input operation of the crown 300 is then determined, and the count of the internal counter 433 is adjusted based on the detected time difference.

As a result, if the count kept by the internal counter 433 differs from the current time within +/−3 seconds, the count of the internal counter 433 can be synchronized to the hands and the current time by the simple operation of manually setting the hands to the current time and then pushing the crown 300 in. Therefore, even when the time data cannot be received, the time can be adjusted by means of a simple design, that is, the count of the internal counter 433 and the hand positions can be synchronized and the correct current time can be displayed by changing the displayed time according to the current time obtained from a time announcement, and the time can be correctly adjusted thereafter when the time data can be received.

The operation of this alternative embodiment described in the flow chart shown in FIG. 13 could be premised on time adjustment as described in the first embodiment above, or it could be premised on time adjustment as described in the second embodiment above. More specifically, after synchronizing the hands and the counts of the internal counter 433, which is the kept-time storage means, this alternative embodiment is effective for correcting small discrepancies of less than one minute, and is therefore desirably used in combination with the first embodiment or the second embodiment. In this case the operation of the crown 300 can be changed by using it in conjunction with another button to implement the control method of the incorporated embodiment or the control method of this alternative embodiment.

This alternative embodiment shall also not be limited to configurations in combination with the first embodiment or second embodiment. Specifically, the configuration for synchronizing the counts of the internal counter 433 and the hand positions could use a method employing a conventional hand position sensor, or a method that moves the hands to a predetermined position for initialization. For example, the user pulls the crown 300 out and sets the hands to 00:00:00, then pushes the crown 300 in to initialize the counts of the internal counter 433 to 00:00:00, and thus synchronizes the counts of the internal counter 433 to the positions of the hands. Then, if the counts of the internal counter 433 and the hand positions go out of synchronization because the hands are moved by an external shock, the operation described in FIG. 13 can be applied.

It will thus be apparent that once the counter and the hands are synchronized, the time can later be adjusted based only on the seconds value if synchronization is lost, and the time can be easily adjusted by means of a simple configuration.

Furthermore, this alternative embodiment of the invention shall not be limited to a radio-controlled timepiece having a reception means for receiving a standard time signal containing time data. Clocks that have an internal generator such as a solar cell and a power-saving mode are also known. This power-saving mode suppresses power consumption when power cannot be generated by, for example, stopping the movement and only continuing to count the current time kept by the internal counter 433. Such clocks have a configuration comparable to the internal counter 433 for keeping time synchronized to the hands. This present alternative embodiment of the invention can be used in such clocks having this internal counter when the hands or internal counter are out of synchronization with the current time.

Aspects of the Alternative Embodiment

A first aspect of this radio-controlled timepiece has a reception means for receiving a standard time signal containing time data, a timekeeping means for keeping the time based on a reference signal from a reference signal source, a time display means having hands for indicating the time by means of the hands, a drive means for moving the hands according to the time, and an external operating member enabling changing the time display means by means of a specific input operation, and adjusts the time based on time data received by the reception means. This radio-controlled timepiece is characterized by comprising an operation detection means for detecting a specific input operation that is the external operating member being operated from a state in which the time indicated by the display means can be changed to a state in which the indicated time cannot be changed; a controller for setting only the seconds value of the time kept by the timekeeping means to a specific value when the operation detection means detects the specific input operation; and a time-adjustment means for adjusting the kept time based on the time difference between the seconds value of the time set to this specific value, and the seconds value of the time kept by the timekeeping means immediately before detection of the specific input operation.

When thus comprised and the operation detection means detects the specific input operation of the external operating member enabled to change the time indicated by the time display means, only the seconds value of the time kept by the timekeeping means is set to a specific value. The time difference between the seconds value of the time kept by the timekeeping means just before the specific input operation of the external operating member was detected and the set specific value is then detected, and the kept time is adjusted based on this detected time difference. As a result, the seconds value of the kept time is corrected to the specified value when the hour, minute, and second hands are manually changed to the current time by means of the external operating member, for example, and a specific input operation of the external operating member is performed according to the current time. If the second hand is manually adjusted at this specified value, such as at the 0 second, then the seconds value of the current time, indication of the second hand, and the seconds value of the kept time will also be synchronized to the specified value, such as the 0 second, i.e., the moment the input operation is performed. If the time difference between this set specific value (such as the 0 second) and the seconds value of the kept time just before the input operation was executed is then calculated, how much the seconds value of the kept time is offset from the current time can be determined. Therefore, if the minute value of the kept time is corrected according to this time difference, the kept time can be set to the current time within certain conditions. These specific conditions are needed because only the seconds value is compared and corrected and adjustment is therefore not possible if the time difference is greater than one minute, and the time can generally be correctly adjusted if the offset of the kept time to the current time is within +30 seconds. It should be noted that the time difference is typically within +/−3 seconds, and the time can therefore be correctly adjusted in most cases.

A hand position sensor and synchronization of the hands are therefore unnecessary, as described in the first embodiment, the parts count can therefore be reduced compared with a timepiece having a hand position sensor, manufacturability and productivity can therefore be improved and cost reduced, and the hands can be set more easily when compared with a timepiece for which synchronization of the hands is required. Furthermore, the kept time can be adjusted to the current time even when signal reception is not possible.

A second aspect of this radio-controlled timepiece is the first aspect of the radio-controlled timepiece described above further comprising a kept-time storage means for storing the timekeeping data, and a current time storage means for storing the time data received by the reception means and storing current time data updated from this time data by a reference signal from a reference signal source. When the operation detection means detects the specific input operation, the controller sets only the seconds value of the time data stored by the kept-time storage means to a predetermined value, and the time-adjustment means corrects the time stored in the kept-time storage means based on the time difference between the seconds value stored in the kept-time storage means immediately before detection of the specific input operation, and the seconds value of the kept-time storage means set to the predetermined value by the controller.

The kept-time storage means and current time storage means can be configured using counters, for example, that update when the reference signal is applied.

Because this configuration also does not require a hand position sensor or synchronization of the hands, the parts count can be reduced compared with a timepiece having a hand position sensor, manufacturability and productivity can therefore be improved and cost reduced, and the hands can be set more easily when compared with a timepiece for which synchronization of the hands is required. Furthermore, the kept time can be adjusted to the current time even when signal reception is not possible.

A control method for a radio-controlled timepiece according to a third aspect of the invention is a control method for a radio-controlled timepiece that adjusts the kept time indicated by hands based on a received standard time signal containing received time data, and is characterized by setting only the seconds value of the kept time to a predetermined value when a specific input operation by an external operating member that can change the displayed time is recognized, and adjusts the time that is kept based on the time difference between the seconds value of the time set to this predetermined value and the seconds value of the time kept immediately before the specific input operation was recognized.

This configuration affords the same practical benefits as the first aspect described above.

A timepiece according to a fourth aspect of the invention is a timepiece having a timekeeping means for keeping the time based on a reference signal from a reference signal source, a time display means having hands for indicating the time by means of the hands, a drive means for moving the hands according to the time, and an external operating member for setting the time display means to an adjustable state by means of a specific input operation. This timepiece is characterized by comprising an operation detection means for detecting a specific input operation that is the external operating member being operated from a state in which the time indicated by the display means can be changed to a state in which the indicated time cannot be changed; a controller for setting only the seconds value of the time kept by the timekeeping means to a specific value when the operation detection means detects the specific input operation; and a time-adjustment means for adjusting the kept time based on the time difference between the seconds value of the time set to this specific value, and the seconds value of the time kept by the timekeeping means immediately before detection of the specific input operation.

A control method for a timepiece according to a fifth aspect of the invention is characterized by setting only the seconds value of the kept time to a predetermined value when a specific input operation by an external operating member that is enabled to change the kept time displayed by the hands is recognized, and adjusts the time that is kept based on the time difference between the seconds value of the time set to this predetermined value and the seconds value of the time kept immediately before the specific input operation was recognized.

These configurations afford the same practical benefits as the first aspect described above.

APPLICATION IN INDUSTRY

The present invention can be used in analog radio-controlled timepieces that adjust the time by receiving a standard time signal, for example.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A radio-controlled timepiece having a reception means for receiving a standard time signal containing time data, a timekeeping means for keeping time based on a reference signal from a reference signal source, a time display means having hands and indicating the time by means of the hands, a drive means for moving the hands according to the time, and an external operating member enabling changing the time display means by means of a first specific input operation, said timepiece being effective for adjusting its time based on time data received by the reception means, said radio-controlled timepiece comprising:

an operation detection means for detecting a second specific input operation of the external operating member;

a controller for resetting only the seconds value of the time kept by the timekeeping means to a specific value and starting timekeeping by the timekeeping means in response to the operation detection means detecting the second specific input operation; and a time-adjustment means for adjusting the time indicated by the time display means based on a time difference between the seconds value of received time data and the seconds value of the timekeeping means when time data is first received after the second specific input operation.

2. The radio-controlled timepiece of claim 1, further comprising:

a kept-time storage means for storing internal timekeeping data; and a current time storage means for storing time data received by the reception means;

wherein the time-adjustment means determines said time difference between the seconds value of the received time data and the timekeeping means by comparing the seconds value stored in the kept-time storage means and the seconds value of the current time storage means.

3. The radio-controlled timepiece of claim 2, wherein the time-adjustment means sets the time data stored in the kept-time storage means to the received time data after obtaining said time difference.

4. The radio-controlled timepiece of claim 1, wherein:

the controller determines that the reset seconds value of the timekeeping means lags the seconds value of the received time data based on the time difference therebetween if the time difference is within −3 seconds, and is leads the received time data if the time difference is within +30 seconds; and the time-adjustment means adjusts the indicated time based on this determination.

5. The radio-controlled timepiece of claim 1, wherein the controller resets the seconds value of the kept time to 0 seconds as the predetermined value.

6. The radio-controlled timepiece of claim 1 wherein:

the controller resets the seconds value of the kept time to 0 seconds as the predetermined value;

the controller determines that the reset seconds value of 0 and subsequently kept time by the timekeeping means is fast relative to the seconds value of the received time data if the time difference therebetween is greater than 0 seconds and not greater than 30 seconds, and is slow relative to the seconds value of the received time data if said time difference is greater than 30 seconds and not greater than 60 seconds; and the time-adjustment means adjusts the indicated time based on this determination of the controller.

7. A radio-controlled timepiece comprising:

a reception means for receiving a standard time signal containing update time data;

a timekeeping means for keeping time based on a reference signal from a reference signal source;

an analog time display means having hands for indicating the time;

a drive means for driving the analog time display means according to the time;

an external operating member enabling changing the time display means by means of a first specific input operation;

an operation detection means for detecting a second specific input operation of the external operating member;

a time-adjustment means for adjusting the time based on update time data received by the reception means;

wherein, when update time data is first received after the operation detection means detects the second specific input operation of the external operating member, the time-adjustment means resets corresponding time data in the time data kept by the timekeeping means using at least part of the received update time data, and until a third specific input operation of the external operating member is detected, comparing received update time data and the kept-time data when time data is subsequently received, and based on a time difference therebetween adjusting the kept-time data and the hands.

8. The radio-controlled timepiece of claim 7, further comprising:

a kept-time storage means for storing kept-time data; and a current time storage means for storing update time data received by the reception means;

wherein the time-adjustment means resets said corresponding time data in the time data kept by the timekeeping means by transferring at least part of the received update time data to the kept-time storage means; and the received update time data is compared with the kept-time data by comparing received update time data with time data in the kept-time storage means.

9. The radio-controlled timepiece of claim 8, wherein:

the analog time display means includes hands for indicating time data composed of hours, minutes, and seconds, and an analog calendar display means for indicating calendar data including a date;

the timekeeping means includes said time data and calendar data; and when update time data is first received after the operation detection means detects the second specific input operation of the external operating member, the time adjustment means further stores at least the calendar data from the received update time data in the kept-time storage means.

10. The radio-controlled timepiece of claim 7, further comprising a controller; wherein:

the standard time signal is transmitted at one-second intervals;

the controller compares the timing of a first specific change in each received standard time signal with the timing of a second specific change in said reference signal of the timekeeping means, and if the second specific change occurs in a time period within +0.5 seconds of the first specific change then determining that the timepiece is fast by the time period, and determining that the timepiece is slow by the time period if said time period is within −0.5 second; and the time-adjustment means adjusts the kept time based on this determination.

11. A control method for a radio-controlled timepiece that adjusts a kept time indicated by hands based on a received standard time signal containing update time data, said control method comprising:

resetting only the seconds value of the kept time to a predetermined value and starting timekeeping when a specific input operation of an external operating member that can change the displayed time is recognized; and adjusting the displayed time based on a time difference between the seconds value of the kept time and the seconds value of received update time data when the update time data is first received following the resetting of the seconds value of the kept time to the predetermined value.

12. A control method for a radio-controlled timepiece that adjusts a kept time indicated by an analog time display means having hands based on a received standard time signal containing update time data, wherein the kept time is maintained by a timekeeping means; said control method comprising:

when update time data is first received after a first specific input operation of an external operating member that can change the displayed time is recognized, setting corresponding kept-time data in said timekeeping means using at least part of the information in the received update time data; and until a second specific input operation of the external operating member is detected, comparing received update time data and the kept-time data when update time data is thereafter received, and based on a time difference therebetween adjusting the kept-time data and the hands.

13. A radio-controlled timepiece having a signal receiver for receiving a standard time signal containing update time data, a timekeeping structure for keeping time based on a reference signal from a reference signal source, a time display having time indicating hands, a driver for moving the hands according to the time, and an external operating member enabling changing the time display by means of a first specific input operation, said timepiece being effective for adjusting its kept time based on received update time data, said radio-controlled timepiece comprising:

an operation detector for detecting a second specific input operation of the external operating member;

a controller for resetting only the seconds value of the time kept by the timekeeping structure to a specific value and restarting the timekeeping operation of the timekeeping structure in response to the operation detector detecting the second specific input operation; and a time-adjustor for adjusting the time indicated by the time display based on a time difference between the seconds value of received update time data and the seconds value of the timekeeping structure when update time data is first received after the second specific input operation.

14. The radio-controlled timepiece of claim 13, further comprising:

a kept-time storage for storing internal timekeeping data; and a current time storage for storing time data received by the receiver;

wherein the time-adjustor determines said time difference between the seconds value of the received update time data and the timekeeping structure by comparing the seconds value stored in the kept-time storage and the seconds value of the current time storage.

15. The radio-controlled timepiece of claim 14, wherein the time-adjustor sets the time data stored in the kept-time storage to the received update time data after obtaining said time difference.

16. The radio-controlled timepiece of claim 13, wherein:

the controller determines that the reset seconds value of the timekeeping structure is lags the seconds value of the received update time data based on the time difference therebetween if the time difference is within −30 seconds, and leads the received time data if the time difference is within +30 seconds; and the time-adjustor adjusts the indicated time based on this determination.

17. The radio-controlled timepiece of claim 13, wherein the controller resets the seconds value of the kept time to 0 seconds as the predetermined value.

18. The radio-controlled timepiece of claim 13 wherein:

the controller resets the seconds value of the kept time to 0 seconds as the predetermined value;

the controller determines that the reset seconds value of 0 and subsequently kept time by the timekeeping structure is fast relative to the seconds value of the received update time data if the time difference therebetween is greater than 0 seconds and not greater than 30 seconds, and is slow relative to the seconds value of the received update time data if said time difference is greater than 30 seconds and not greater than 60 seconds; and the time-adjustor adjusts the indicated time based on this determination of the controller.

* * * * *

UNITED STATES PATENT AND TRADEMARK OFFICE

CERTIFICATE OF CORRECTION

PATENT NO. : 7,075,859 B2
APPLICATION NO. : 10/813386
DATED : July 11, 2006
INVENTOR(S) : Fumiaki Miyahara et al.

It is certified that error appears in the above-identified patent and that said Letters Patent is hereby corrected as shown below:

Title page,
Item [56], FOREIGN PATENT DOCUMENTS,

Please change "EP 0 682 382" to -- EP 0 682 302 --.

Column 36

Line 32, please change "within -3 seconds," to -- within -30 seconds,--.

Signed and Sealed this

Third Day of June, 2008

JON W. DUDAS
*Director of the United States Patent and Trademark Office*